United States Patent [19]

Ohta et al.

[11] Patent Number: 5,065,664

[45] Date of Patent: Nov. 19, 1991

[54] CONTROL CIRCUIT FOR A CYLINDER ALLOWING FLOW BETWEEN AN UPPER AND A LOWER CHAMBER

[75] Inventors: Shuji Ohta; Toshiyuki Takeuchi, both of Kariya, Japan

[73] Assignee: Kabushiki Kaisha Toyoda Jidoshokki Seisakusho, Kariya, Japan

[21] Appl. No.: 502,340

[22] Filed: Mar. 30, 1990

[30] Foreign Application Priority Data

Apr. 3, 1989 [JP] Japan ..... 1-84574

[51] Int. Cl.[5] ..... F15B 13/042

[52] U.S. Cl. ..... 91/420; 91/436; 91/440; 60/474

[58] Field of Search ..... 91/420, 436, 440; 60/474

[56] References Cited

U.S. PATENT DOCUMENTS

| | | | |
|---|---|---|---|
| 2,590,454 | 3/1952 | Pilch | 91/420 |
| 3,068,596 | 12/1962 | Hein et al. | 91/436 |
| 3,071,926 | 1/1963 | Olson et al. | 91/436 |
| 3,129,720 | 4/1964 | Allen et al. | 91/436 |
| 3,156,257 | 11/1964 | Strader | 91/420 |
| 3,267,961 | 8/1966 | Rice | 91/436 |
| 3,523,490 | 8/1970 | Bianchetta | 91/420 |
| 3,654,835 | 4/1972 | Sievenpiper | 91/436 |
| 4,342,256 | 8/1982 | Anderson et al. | 91/420 |
| 4,518,004 | 5/1985 | Hsu et al. | 91/436 |
| 4,657,471 | 4/1987 | Shinoda et al. | 414/663 |
| 5,014,734 | 5/1991 | Smith | 91/436 |

FOREIGN PATENT DOCUMENTS

| | | | |
|---|---|---|---|
| 55-140100 | 10/1980 | Japan . | |
| 57-134006 | 8/1982 | Japan . | |
| 863701 | 3/1961 | United Kingdom | 91/436 |

*Primary Examiner*—Edward K. Look
*Assistant Examiner*—F. Daniel Lopez
*Attorney, Agent, or Firm*—Brooks Haidt Haffner & Delahunty

[57] ABSTRACT

A hydraulic control circuit arrangement for a single-acting cylinder provided with bottom and rod chambers separated by a piston having a piston rod extending the rod chamber, the arrangement including a directional control valve for controlling a supply of an operating oil from a hydraulic pump to the bottom chamber and an evacuation of the operating oil from both the bottom and rod chambers, a first pilot-operated valve for controlling the type of operation of the single-acting cylinder from a ram type to a piston type, and vice versa, in response to a change in an extent of a load applied to the single-acting cylinder during the lifting thereof, a short-circuiting conduit arranged between the bottom and rod chambers of the cylinder to short-circuit a flow of the operating oil from the bottom to rod chamber, and vice versa, a second pilot-operated valve located in the short-circuiting conduit to control the short-circuiting of the flow of operating oil, and a flow control valve for generating a pressure in the bottom chamber of the single-acting cylinder to thereby promote the short-circuiting of the flow of operating oil from the bottom to rod chamber of the single-acting cylinder during the lowering of the cylinder.

20 Claims, 17 Drawing Sheets

Fig. 20
( PRIOR ART )
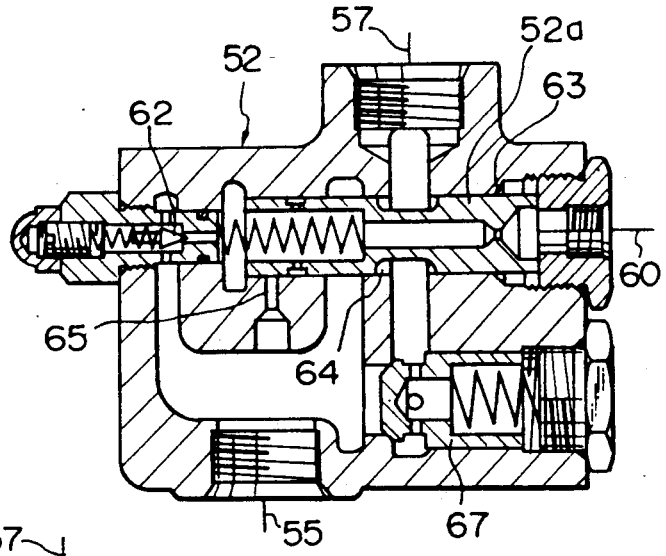
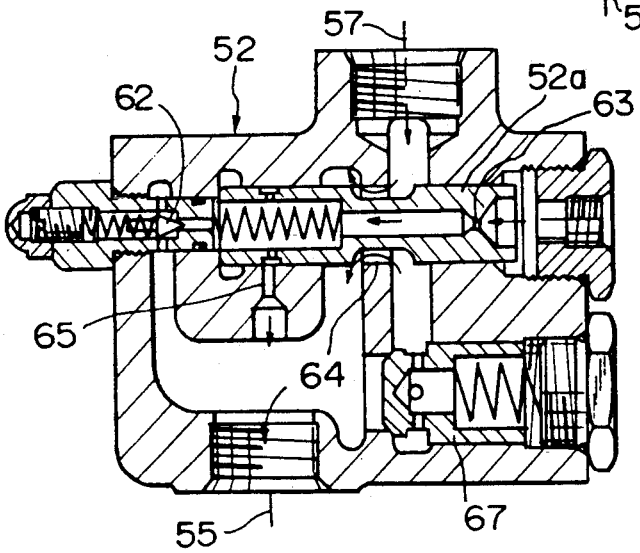
Fig. 21
( PRIOR ART )
Fig. 22
( PRIOR ART )
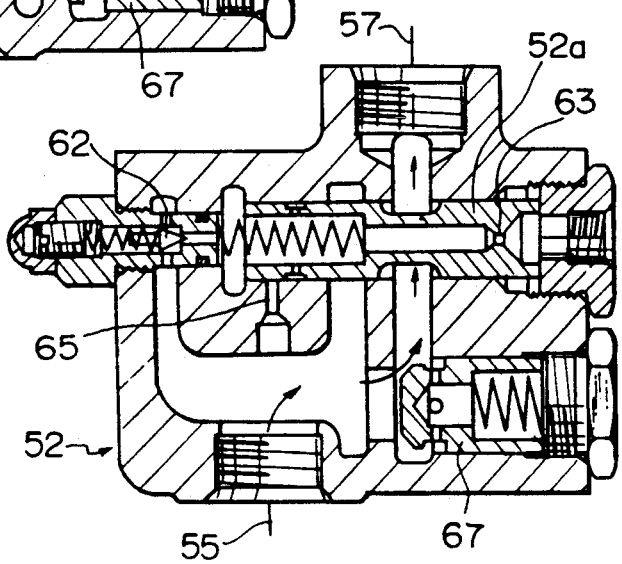

CONTROL CIRCUIT FOR A CYLINDER ALLOWING FLOW BETWEEN AN UPPER AND A LOWER CHAMBER

BACKGROUND OF THE INVENTION

1. Field of the Invention

The present invention relates to a hydraulic control circuit arrangement of a single-acting cylinder adapted to be used as, for example, a hydraulic load lift cylinder of a forklift truck, and more particularly, relates to a hydraulic control circuit arrangement provided with hydraulic directional control and pilot valves and capable of operating a common single-acting vertical cylinder as a ram cylinder for a low load, and as a piston cylinder for a high load.

2. Description of the Related Art

In general, forklift trucks use vertical load lifting cylinders to move up and down a lift member on which a load handling device is mounted, and U.S. Pat. No. 4,657,471 to Shinoda et al discloses a pair of separate load lifting cylinders disposed adjacent to a front upright assembly of the truck in such a manner that the two load lifting cylinders are laterally spaced apart to improve the forward view from the driver's seat of the forklift truck.

The operation of the load lifting cylinder is controlled by a hydraulic control circuit arrangement such as that disclosed in, for example, Japanese Unexamined (Kokai) Patent Application No. 57-134006. This known hydraulic control circuit arrangement of JUP-A-57-134006 is provided with a hydraulic pump and a control valve.

Other typical conventional hydraulic control circuit arrangements for controlling the operation of single-acting vertical cylinders are shown in the accompanying FIGS. 19 through 27, in which FIGS. 19 through 22 show a first type of such an arrangement in which a pilot operated valve 52 operable to switch the operation of a single-acting cylinder 53, e.g., a single-acting lift cylinder, from a ram type operation to a piston type operation, and vice versa, is independently arranged in a hydraulic circuit to connect the single-acting cylinder 53 and a manually operated directional control valve 51, and FIGS. 23 through 27 show a second type of such an arrangement in which a similar pilot operated valve 52 is built-in to a spool 51*a* of a manually operated directional control valve 51.

In the above first and second types of conventional hydraulic control circuit arrangements, when the directional control valve 51 (the other manually operated directional control valve 51*a* is arranged for controlling the operation of a non-illustrated single-acting cylinder) is shifted to a position at which a pump conduit 54 of a hydraulic pump P communicates with a bottom side conduit 56 of the single-acting cylinder 53, an operating oil from the hydraulic pump P is supplied to a bottom side chamber 58 of the cylinder 53 to thereby cause a lifting motion of the single-acting cylinder 53. Nevertheless, when a hydraulic pressure acting on the pilot-operated valve 52 from a pilot line 60 connected to the bottom side conduit 56 is lower than a set pressure of the pilot-operated valve 52, i.e., when the single-acting cylinder 53 is subjected to a light load, no lifting motion of the pilot-operated valve 52 occurs while maintaining the position thereof shown in FIG. 19 or FIG. 23. That is, as shown in FIG. 20 or 25, a rod side conduit 57 of the single-acting cylinder 53 is prevented by the pilot-operated valve 52 from communication with a tank conduit 55 of a hydraulic tank T, and as a result, an operating oil in a rod side chamber 59 of the single-acting cylinder 53 flows through a check valve 61 disposed in the piston of the single-acting cylinder 53 into the bottom side chamber 58. Accordingly, the cylinder 53 acts as a ram type cylinder having a pressure receiving area corresponding to the cross-sectional area of the piston rod having a diameter "d".

On the other hand, when the directional control valve 51 is shifted to connect the pump conduit 54 with the bottom side conduit 56 of the single-acting cylinder 53, and when the hydraulic pressure in the pilot line 60 is higher than the set pressure of the pilot-operated valve 52, i.e., when the single-acting cylinder 53 is subjected to a heavy load, the pilot pressure passing through an orifice 63 acts on a needle valve 62 of the pilot-operated valve 52 whereby the needle valve 62 is urged to an open position thereof. Accordingly, a pressure differential appears across the orifice 63 to shift a pilot spool 52*a* of the pilot-operated valve 52 from the position shown in FIG. 20 or 25 to a leftward position shown in FIG. 21 or 26. Accordingly, the rod side conduit 57 of the single-acting cylinder 53 is connected with the tank conduit 55 through a passage 64 of the pilot-operated valve 52, and therefore, the operating oil in the rod side chamber 59 of the single-acting cylinder 53 flows through the rod side conduit 57 and the tank conduit 55 toward the hydraulic tank T, and thus the single-acting cylinder 53 acts as a piston type cylinder having a pressure receiving area corresponding to the cross-sectional area of the piston having a diameter D thereof. When the single-acting cylinder 53, i.e., the lift cylinder, begins to act as the piston type cylinder, a hydraulic pressure exerted by the hydraulic pump P is temporarily lowered, and therefore, the needle valve 62 is shifted to return to a closed position thereof due to the lowering of the pressure of a pilot line 60. Nevertheless, when the pilot spool valve 52*a* of the pilot operated valve 52 is shifted to the open position thereof, whereat the rod side conduit 57 is communicated with the tank side conduit 55, the pilot line 60 communicates with the tank conduit 55 through a passage 65 of the pilot-operated valve 52 to permit a flow of the pilot oil in the pilot line 60 through the orifice 63. Therefore, a pressure differential across the orifice 63 is maintained, and accordingly, the pilot spool 52*a* of the pilot-operated valve 52 is also maintained at the open position thereof until the directional control valve 51 is manually shifted to a neutral position.

When the directional control valve 51 is manually shifted to a position for connecting the bottom side conduit 56 of the single-acting cylinder 53 with the tank conduit 55 of the hydraulic tank T, the operating oil in the bottom side chamber 58 of the cylinder 53 is allowed to return to the tank T, and accordingly, a lowering motion of the single-acting lift cylinder 53 occurs to generate a negative pressure condition in the rod side chamber 59 of the lift cylinder 53. At this stage, an orifice or choke 66 disposed in the tank conduit 55 generates a rise in the pressure in the tank conduit 55, and as a result, a pressure differential appears between the rod side chamber 59 of the single-acting cylinder 53 and the tank conduit 55, due to the negative pressure in the chamber 59 and the pressure rise in the tank conduit 55, and a flow of an operating oil in the tank conduit 55 having a rising pressure into the rod side chamber 59 of the single-acting cylinder 53 is allowed by a forcible opening of a check valve 67 disposed in the pilot-operated valve 52 as shown in FIG. 22 of the first type control circuit arrangement, and therefore, the lowering motion of the cylinder 53 occurs.

In the second type control circuit arrangement, as shown in FIG. 27, an operating oil in the bottom side conduit 56 of the single-acting cylinder 53 flows into the rod side chamber 59 of the cylinder 53 via a tank port of the directional control valve 51 and the rod side conduit 57, and therefore, the lowering motion of the cylinder 53 occurs.

In the above-described conventional first and second types of hydraulic control circuit arrangements for the single-acting lift cylinder 53, the orifice or choke 66 must be provided in the tank conduit 55, to allow a flow of the operating oil from the bottom side conduit 56 to the rod side chamber 59 of the lift cylinder 53, and thus compensate for an expansion of the rod side chamber 59 which occurs during a lowering of the cylinder 53. Nevertheless, the orifice or choke 66 in the tank conduit 55 brings the following defect. Namely, when the hydraulic pump P is operated, even if the single-acting lift cylinder 53 is not operated, a given amount of an operating oil flows from the hydraulic pump P into the hydraulic tank T through the orifice or choke 66, and therefore, a constant load is applied by the orifice 66 to the hydraulic pump P. Accordingly, a loss of an hydraulic energy as well as a heating of the operating oil occur, due to the existence of the orifice or choke 66 in the tank conduit 55.

Also, in the hydraulic control circuit arrangement for the single-acting lift cylinder, the rod side conduit 57 must have a large diameter. This is because the operating oil must always flow smoothly into the rod side chamber 59 through the rod side conduit 57, under a lowest possible flow resistance. But when the single-acting lift cylinders are arranged in a forklift truck, the rod side conduits 57 must be disposed to run along the upright masts of the truck, and therefore, if these conduits 57 are made of pipes having a large diameter, the forward view from a driver seat of the forklift truck is obstructed.

In addition, in the first type hydraulic control circuit arrangement shown in FIG. 19, when the single-acting lift cylinder 53 is operated to act as a piston type cylinder for supporting a given load from the underside, the pilot line 60 is held in communication with the tank conduit 55 through the passage 65 of the pilot-operated valve 52. Accordingly, an operating oil in the bottom side conduit 56 of the cylinder 53 gradually leaks into the tank conduit 55 through the pilot line 60 and the passage 65, and therefore, an unfavorable gradual lowering of the lift cylinder 53 occurs due to the force of gravity. Furthermore, such a gradual lowering of the lift cylinder 53 causes a gradual expansion of the rod side chamber 59 of the single-acting lift cylinder 53, without compensation, and thus it is filled by an introduction of the operating oil. As a result, when the lift cylinder 53 is subsequently operated to act as a ram type cylinder, the cylinder 53 initially acts as a piston type cylinder before acting as a ram cylinder. Thus such a time lag occurs before the start of the ram cylinder operation.

SUMMARY OF THE INVENTION

Therefore, an object of the present invention is to obviate the above-mentioned defects encountered by the conventional hydraulic control circuit arrangements for a single-acting cylinder.

Another object of the present invention is to provide an improved hydraulic control circuit arrangement for a single-acting cylinder, capable of quickly switching the operation of the single-acting cylinder from a piston type cylinder to a ram type cylinder, and vice versa, without a time lag.

A further object of the present invention is to provide a hydraulic control circuit arrangement for a single-acting cylinder, in which a flow of the operating oil from the bottom side to the rod side of the cylinder is achieved by a shorter conduit giving a smaller resistance to the flow of the operating oil, whereby the operating accuracy in the single-acting cylinder is increased.

A still further object of the present invention is to provide a hydraulic control circuit arrangement for a single-acting cylinder, by which a forward view from a forklift truck is improved when the single-acting cylinders are used as lift cylinders of the lift truck.

Therefore, in accordance with the present invention, there is provided a hydraulic control circuit arrangement for a single-acting cylinder having a slidable piston element in a cylinder housing, first and second cylinder chambers separated by the piston element, and a piston rod extending from the piston element to an outer end thereof through the second cylinder chamber, which comprises:

a hydraulic power source for supplying an operating oil for operating the single-acting cylinder;

a hydraulic tank for receiving and storing the operating oil;

a directional control valve arranged between the hydraulic power source and the single-acting cylinder for controlling a supply of the operating oil from the hydraulic power source to the single-acting cylinder, the directional control valve being shiftable from a neutral position to one of a first position whereat the first chamber of the single-acting cylinder is connected to the hydraulic power source and a second position whereat the first chamber of the single-acting cylinder is connected to the hydraulic tank;

a first conduit for providing a fluid connection between the first chamber of the single-acting cylinder and the directional control valve;

a second conduit for providing a fluid connection between the second chamber of the single-acting cylinder and the hydraulic tank;

a third conduit for providing a short-circuiting fluid connection between the first and second chambers of the single-acting cylinder;

a first pilot-operated valve for controlling an evacuation of the operating oil from the second chamber of the single-acting cylinder through the second conduit in response to a change in a pressure in the first chamber of the single-acting cylinder with respect to a preset pressure when the directional control valve is shifted to and maintained at the first position thereof;

a flow control valve arranged in the first conduit and having an inlet port thereof directly and fluidly connected to both the first chamber of the single-acting cylinder and the third conduit, and an outlet port thereof directly connected to the directional control valve, the flow control valve controlling a flow of the operating oil in the first conduit when the operating oil flows out of the first chamber of the single-acting cylinder, to thereby generate a pressure differential thereacross; and a second pilot-operated valve arranged in the third conduit and urged to a first position thereof whereat a short-circuit fluid connection is made between the first and second chambers of the single-acting cylinder through the third conduit when the directional control valve is shifted to the second position thereof, the second pilot-operated valve being shifted from the first position thereof to a second position thereof to allow the operating oil to flow from the first to second chambers of the single-acting cylinder only when the directional control valve is shifted to the first position.

BRIEF DESCRIPTION OF THE DRAWINGS

The above and other objects, features and advantages of the present invention will be made more apparent from the ensuing description of the embodiments, taken in conjunction with the accompanying drawings wherein:

FIG. 20 is a cross-sectional view of a pilot-operated valve of the control circuit arrangement of FIG. 19, illustrating a neutral position of the pilot-operated valve whereat the single-acting lift cylinder acts as a ram type lift cylinder;

FIG. 21 is a similar cross-sectional view of the pilot-operated valve, illustrating a position whereat the single-acting lift cylinder acts as a piston type lift cylinder;

FIG. 22 is a similar cross-sectional view of the pilot-operated valve, illustrating a position whereat the single-acting lift cylinder is lowered;

DESCRIPTION OF THE PREFERRED EMBODIMENTS

Figure 1:
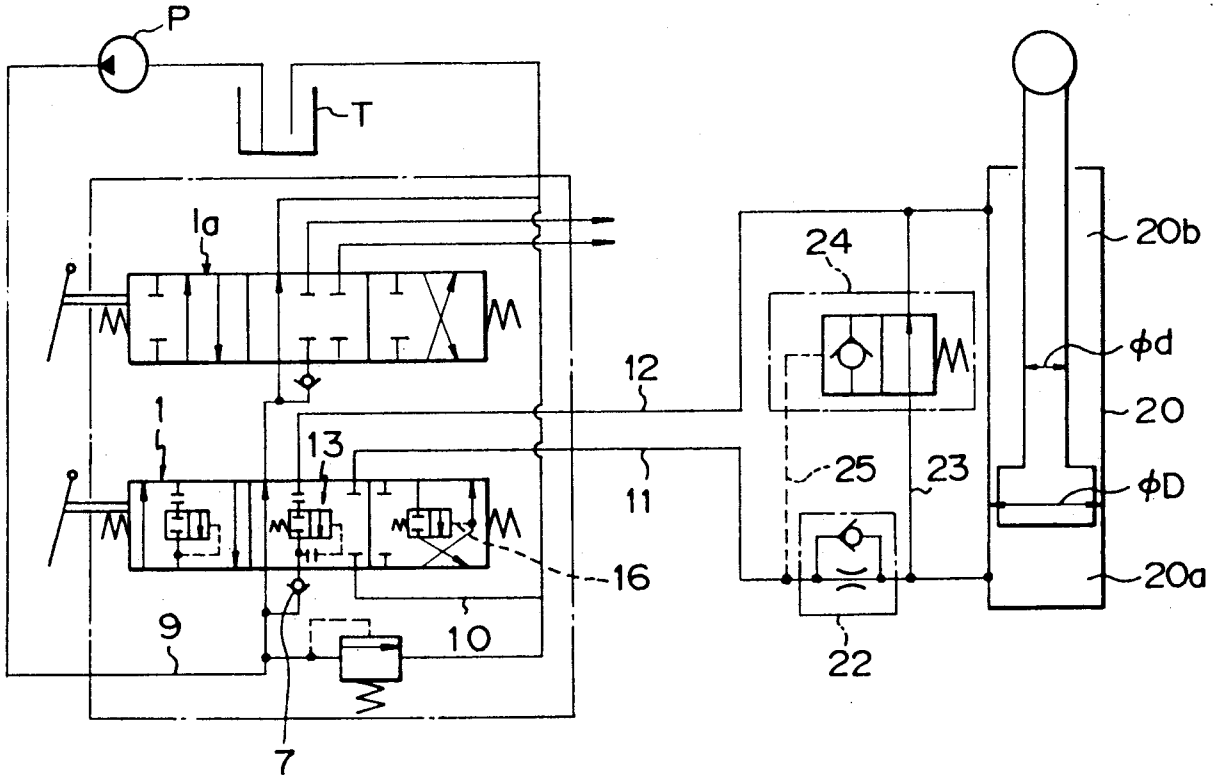
FIG. 1 is a circuit diagram illustrating a acting lift cylinder according to a first embodiment of the present invention.

Referring to FIGS. 1 through 6, which illustrate a first embodiment of the present invention, a hydraulic control circuit arrangement for a single-acting cylinder includes a single-acting lift cylinder 20, a hydraulic pump P supplying an operating oil, a hydraulic tank T receiving the operating oil, a manually operated directional control valve 1 connected to the hydraulic pump P by a conduit and controlling the lifting and lowering motions of the lift cylinder 20, and a pilot-operated valve 13 built-in to the directional control valve 1 and capable of switching the type of the operation of the lift cylinder 20 from a ram type operation to a piston type operation, and vice versa. The mechanical construction of the directional control valve 1 and the pilot-operated valve 13 built-in to the valve 1 are illustrated in FIGS. 2 through 5. The other directional control valve la of FIG. 1 is arranged for another single-acting cylinder (not illustrated in FIG. 1) by using the operating oil supplied from the hydraulic pump P.

As illustrated in FIGS. 2 through 5, the directional control valve 1 is provided with a central by-pass passage 3 connected to a pump conduit 9, a pump port 2 connectable to the central by-pass passage 3 via a check valve 7, a tank port 4 connectable to a tank conduit 10, a bottom side port 5 connectable to a bottom side conduit 11 of the single-acting lift cylinder 20, and a rod side port 6 connectable to a rod side conduit 12 of the single-acting lift cylinder 20. The directional control valve 1 is also provided with a valve spool 8 slidably shiftable from a neutral position thereof shown in FIG. 2 to either a leftward position (a position for lifting the cylinder 20) shown in FIGS. 3 and 4 or to a rightward position (a position for lowering the lift cylinder 20) shown in FIG. 5, to thereby change a direction of flow of the operating oil supplied from the hydraulic pump P.

The first pilot-operated valve 13 is provided with a pilot spool 14 slidably fitted in the valve spool 8 of the directional control valve 1. The pilot spool 14 has a central bore communicating with a pilot line 16 having an orifice 15 therein, and axially opposite ends receiving a pilot pressure of a pilot oil flowing through the pilot line 16. The pilot line 16 is fluidly connected with the central by-pass passage 3 when the valve spool 8 of the control valve 1 is shifted to the position for lifting the cylinder 20, and is communicated with the pump port 2 when the valve spool 8 of the control valve 1 is shifted to the position for lowering the cylinder 20. The first pilot-operated valve 13 is also provided with a needle valve 17, normally urged to a position closing a part of the pilot line 16. The needle valve 17 is moved to a position providing a fluid communication between the pilot line 16 and the tank port 4 when the pilot pressure is larger than a preset pressure value. When the pilot line 16 is connected with the tank port 4, a flow of the pilot oil occurs through the pilot line 16, whereby a pressure differential appears across the orifice 15 of the pilot line 16. Namely, a difference occurs between the pilot pressures acting on the opposite ends of the pilot spool 14, and therefore, the pilot spool 14 is moved leftward from the neutral position thereof shown in FIG. 2 to a position shown in FIG. 4, and thus the rod side port 6 of the directional control valve 1 is communicated with the tank port 4 through a passage 18.

In the hydraulic control circuit arrangement for the single-acting lift cylinder 20, shown in FIG. 1, a bottom side conduit 11 extends between a bottom side chamber 20*a* (a first chamber) of the cylinder 20 and the bottom side port 5 of the valve 1, and a flow control valve 22 having therein a check valve which permits the operating oil to pass therethrough in only a direction toward the bottom side chamber 20*a* of the cylinder 20 is disposed in the bottom side conduit 11. A conduit 23 having one end connected to the bottom side conduit 11 at a position between the flow control valve 22 and the bottom chamber 20*a* of the lift cylinder 20 is arranged to have the other end thereof connected to the rod side conduit 12 at a position adjacent to a rod side chamber (a second chamber) 20*b* of the lift cylinder 20. Namely, the conduit 23 is arranged to short-circuit between the bottom side conduit 11 and the rod side conduit 12 when a pilot-operated valve 24 (hereinafter referred to as a second pilot-operated valve) arranged in the conduit 23 is shifted to a first open position thereof by a pilot signal given to the second pilot-operated valve 24 by a pilot line 25. The pilot line 25 extends from a position of the bottom side conduit 11 located adjacent to an outlet end of the flow control valve 22, i.e., the position between the directional control valve 1 and the flow control valve 22 and far from the bottom side chamber 20*a* of the lift cylinder 20. The second pilot-operated valve 24 is set at the first open position thereof to establish a fluid communication between the bottom side and rod side conduits 11 and 12 via the short-circuiting conduit 23 as long as the pilot signal, i.e., a pilot pressure of the pilot oil coming from the bottom side conduit 11 via the pilot line 25 is kept lower than a preset pressure value. When the pilot pressure rises above the preset pressure value, the second pilot-operated valve 24 is shifted to a second flow-limited position permitting the operating oil to flow only from the rod side chamber 20*b* toward the bottom side chamber 20*a* of the lift cylinder 20 via a check valve contained in the second pilot-operated valve 24.

Figure 6:
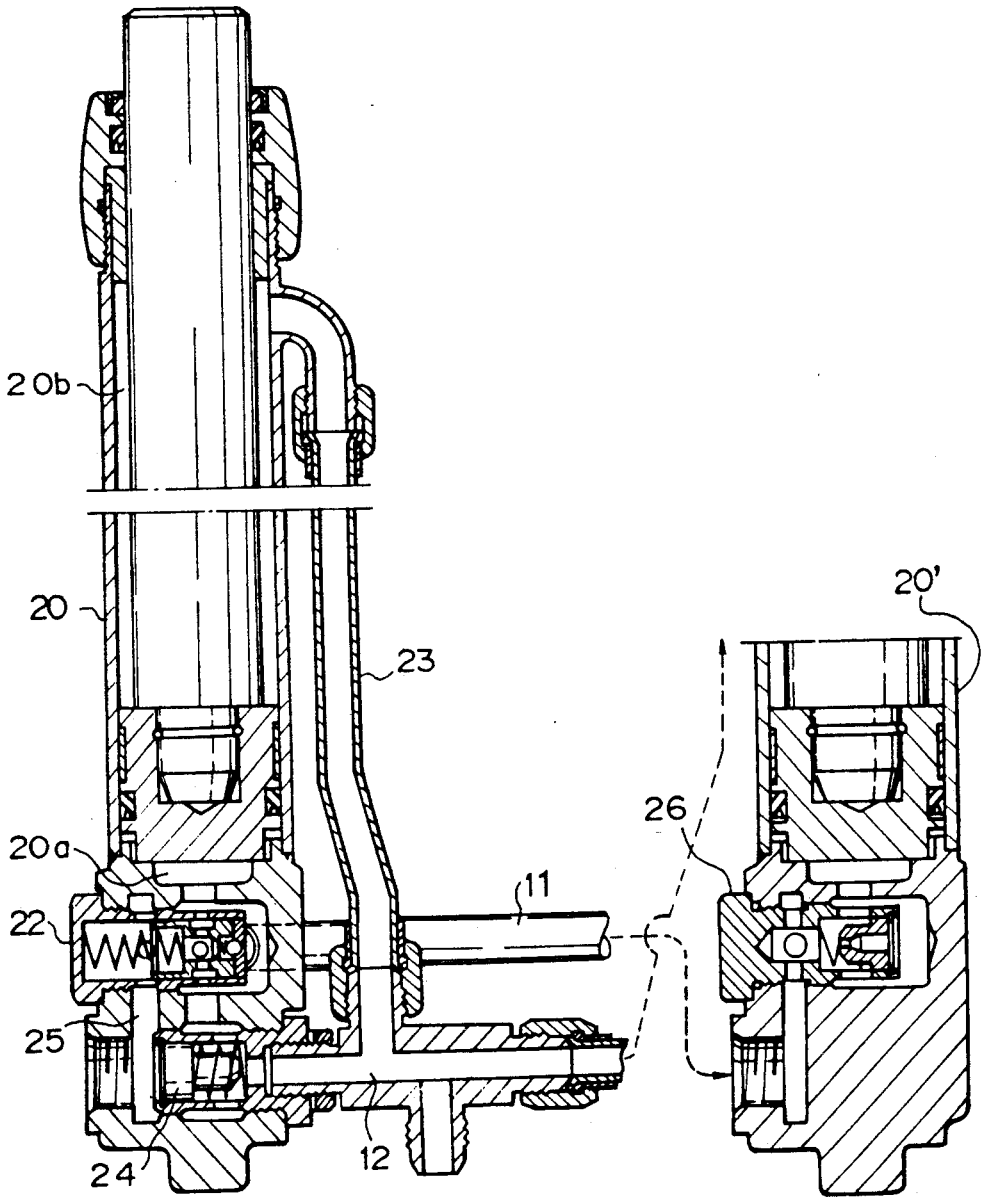
FIG. 6 is a cross-sectional view of a flow control valve and a second pilot-operated valve of the control circuit arrangement of FIG. 1, which are accommodated in a bottom portion of the single-acting lift cylinder.

As best illustrated in FIG. 6, when a condition occurs such that two equal single-acting cylinders 20 and 20′ are commonly controlled by the hydraulic control circuit arrangement according to the present embodiment, i.e., the two single-acting cylinders 20 and 20′ are used as upright lift cylinders of a forklift truck, the flow control valve 22 having the built-in check valve and the pilot-operated valve 24 having the built-in check valve are accommodated in either one of the pair of single-acting lift cylinders 20 and 20′, i.e., in a bottom housing of the lift cylinder 20. A conventional safety valve 26 is then accommodated in the bottom of the other single-acting lift cylinder 20′.

A description of the operation of the above-described hydraulic control circuit arrangement for the single-acting cylinder 20 will be provided hereinbelow with reference to FIGS. 2 through 5.

Figure 2:
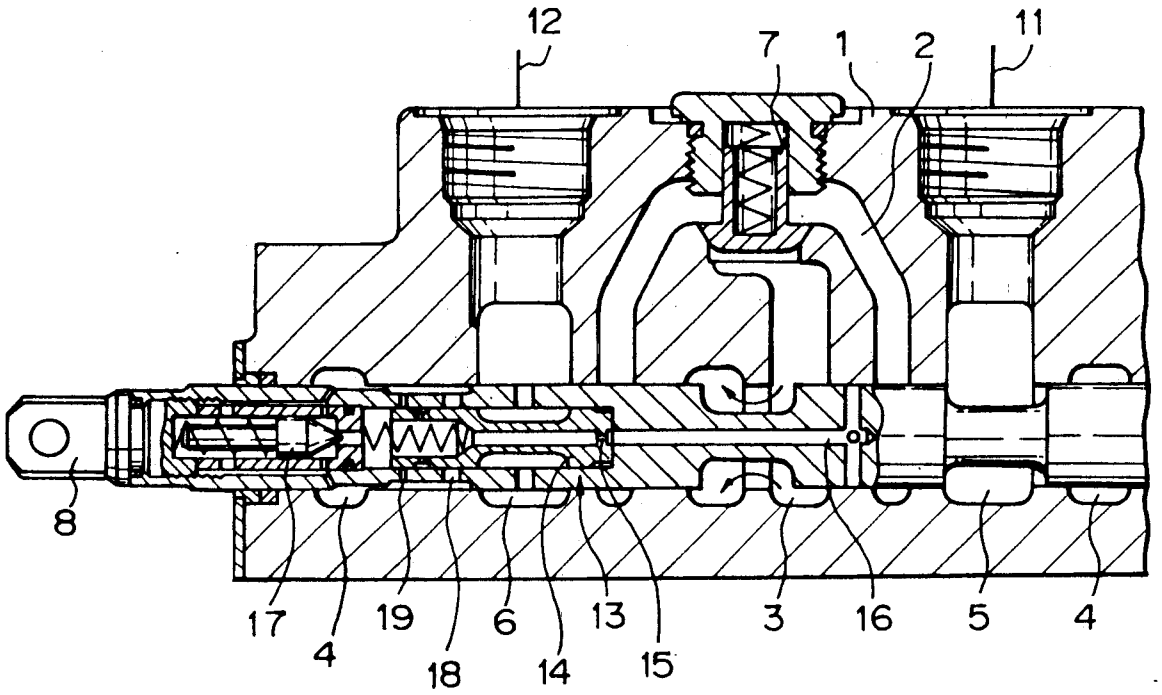
FIG. 2 is a cross-sectional view of a directional control valve incorporating a first pilot-operated valve therein and accommodated in the hydraulic control circuit arrangement of FIG. 1, and illustrating a neutral position of the directional control valve.

Referring to FIG. 2, when the directional control valve 1 in the hydraulic control circuit arrangement is at the neutral position, the rod side conduit 12 of the lift cylinder 20 is interrupted by the valve spool 8 of the directional control valve 1 at the rod side port 6, and the bottom side conduit 11 is interrupted at the bottom side port 5.

Under this condition, when a hydraulic pressure in the bottom side chamber 20*a* of the lift cylinder 20 is low, i.e., when the piston element of the lift cylinder 20 is lowered to the lowest position thereof, the second pilot-operated valve 24 of the short-circuiting conduit 23 is positioned at the first open position. When the piston element of the lift cylinder 20 is stopped at an intermediate position thereof by the support of a high hydraulic pressure in the bottom side chamber 20*a* of the lift cylinder 20, however, the second pilot-operated valve 24 in the short-circuiting conduit 23 is shifted to the second flow-limited position. Namely, whatever the position of the pilot-operated valve 24, as long as the directional control valve 1 is at the neutral position thereof, neither the operating oil in the bottom side chamber 20*a* nor that in the rod side chamber 20*b* of the lift cylinder 20 is lost.

Figure 3:
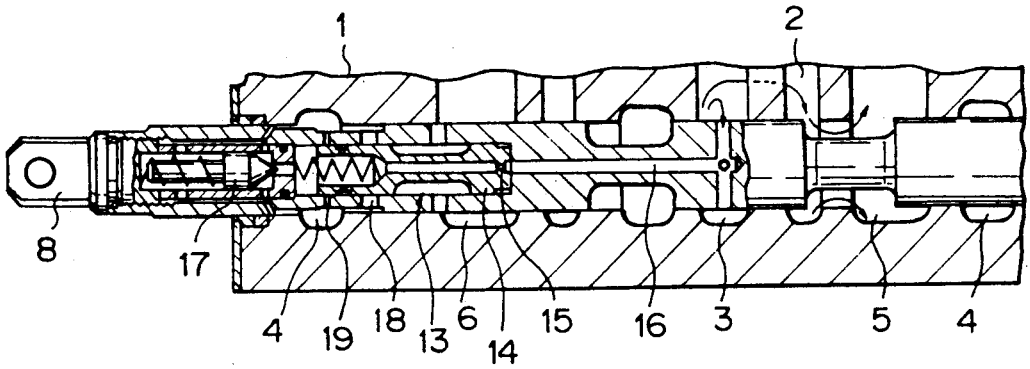
FIGS. 3 and 4 are cross-sectional views of the same valve as that of FIG. 2, illustrating a position of the directional control valve when lifting the single-acting lift cylinder, respectively.
Figure 4:
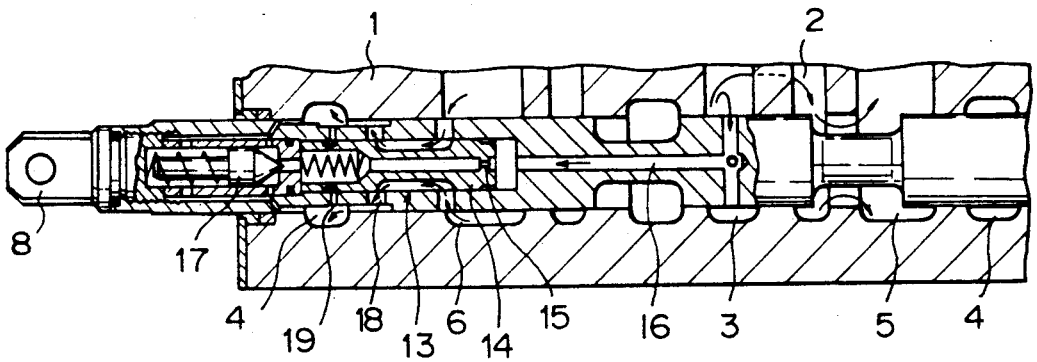

As illustrated in FIGS. 3 and 4, when the valve spool 8 of the directional control valve 1 of the hydraulic control circuit arrangement is shifted from the neutral position thereof of FIG. 2 to the leftward position, i.e., the position for lifting the lift cylinder 20, the pump port 2 and the bottom side port 5 are mutually in communication to allow the operating oil supplied by the hydraulic pump P to flow into the bottom side chamber 20*a* of the lift cylinder 20 through the pump conduit 9 and the bottom side conduit 11. Under this condition, when a hydraulic pressure prevailing in the bottom side conduit 11, i.e., the pressure level in the central by-pass passage 3 of the directional control valve 1, is lower than a preset pressure of the needle valve 17 of the first pilot-operated valve 13 within the directional control valve 1, the rod side conduit 12 is still interrupted by the directional control valve 1. The second pilot-operated valve 24, however, is shifted by a pilot pressure supplied by the pilot line 25 to the second flow-limited position whereat only the operating oil in the rod side chamber **20*b* is allowed to flow into the bottom side chamber 20*a*. Accordingly, the flow of the operating oil from the rod side chamber 20*b* into the bottom side chamber 20*a*** operates the single-acting lift cylinder to act as a ram type cylinder having a pressure receiving area corresponding to the cross-sectional area of the piston rod having the diameter "d".

When the hydraulic pressure prevailing in the central by-pass passage 3 of the directional control valve 1 rises above the preset pressure of the needle valve 17 of the first pilot-operated valve 13, the needle valve 17 is shifted to the open position by a pilot pressure supplied from the pilot line 16. Accordingly, a flow of the pilot oil occurs through the orifice 15 of the pilot line 16 while generating a pressure differential between the pressures acting on both ends of the pilot spool 14 of the first pilot-operated valve 13, and therefore, the pilot spool 14 is shifted to the leftward position as shown in FIG. 4, and thus the rod side port 6 of the directional control valve 1 is connected with the tank port 4 via the passage 18. Namely, the rod side conduit 12 is connected with the tank conduit 10. Nevertheless, as the second pilot-operated valve 24 is shifted by the pilot pressure supplied from the rod side conduit 11 through the pilot line 25 to the second flow-limited position allowing only the operating oil to flow from the rod side chamber **20*b* into the bottom side chamber 20*a* of the lift cylinder 20, the operating oil in the rod side chamber 20*b* flows toward the hydraulic tank T, and therefore, the lift cylinder 20 is operated to act as a piston type cylinder having a pressure receiving area corresponding to the cross-sectional area of the piston having the diameter "D". At the start of the operation of the lift cylinder 20 acting as a piston type cylinder, the pilot pressure in the pilot line 16 temporarily drops, and therefore, the needle valve 17 of the first pilot-operated valve 13 is closed. Before the temporary drop of the pilot pressure, however, as the pilot spool 14 of the pilot-operated valve 13 is shifted to a position whereat the rod side port 6 and the tank port 4 of the directional control valve 1 are mutually connected through the passage 18, the pilot line 16 is connected with the tank port 4 through the passage 19, and therefore, a flow of the pilot oil in the pilot line 16 is maintained to establish a pressure differential across the orifice 15. Therefore, the pilot spool 14 is stopped at the shifted position until the directional control valve 1** is shifted back to the neutral position.

Figure 5:
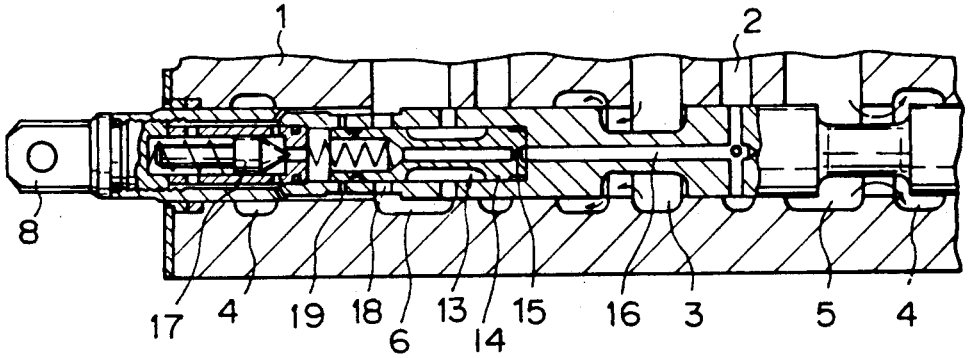
FIG. 5 is a cross-sectional view of the same valve as that of FIG. 2, illustrating a position of the directional control valve when lowering the single-acting lift cylinder.

When the valve spool 8 of the directional control valve 1 is manually shifted to the rightward position as shown in FIG. 5, i.e., the position for lowering the lift cylinder 20, the bottom side port 5 connectable to the bottom side conduit 11 is connected with the tank port 4, and the rod side port 6 connectable to the rod side conduit 11 is disconnected from the tank port 4. Accordingly, the pressure level pravailing in a part of the bottom side conduit 11 downstream of the outlet of the flow control valve 22 drops, and therefore, the pilot pressure coming from that part of the bottom side conduit 11 also drops. Thus, the second pilot-operated valve 24 is shifted to the first open position whereat the short-circuiting conduit 23 is completely opened, to thereby enable the operating oil in the bottom side chamber **20*a* of the lift cylinder 20 to flow into the rod side chamber 20*b* via the short-circuiting conduit 23**.

From the position shown in FIG. 5, it is understood that the pilot pressure for controlling the operation of the first pilot-operated valve 13 is taken from a position corresponding to the pump port 2 due to the rightward shift of the valve spool 8 of the directional control valve 1, and as a result, the pilot spool 14 is shifted leftward when the pressure oil coming from the pump port 2 flows into the pilot line 16. Nevertheless, the rod side port 6 of the directional control valve 1 is not connected with the tank port 4.

Figure 19:
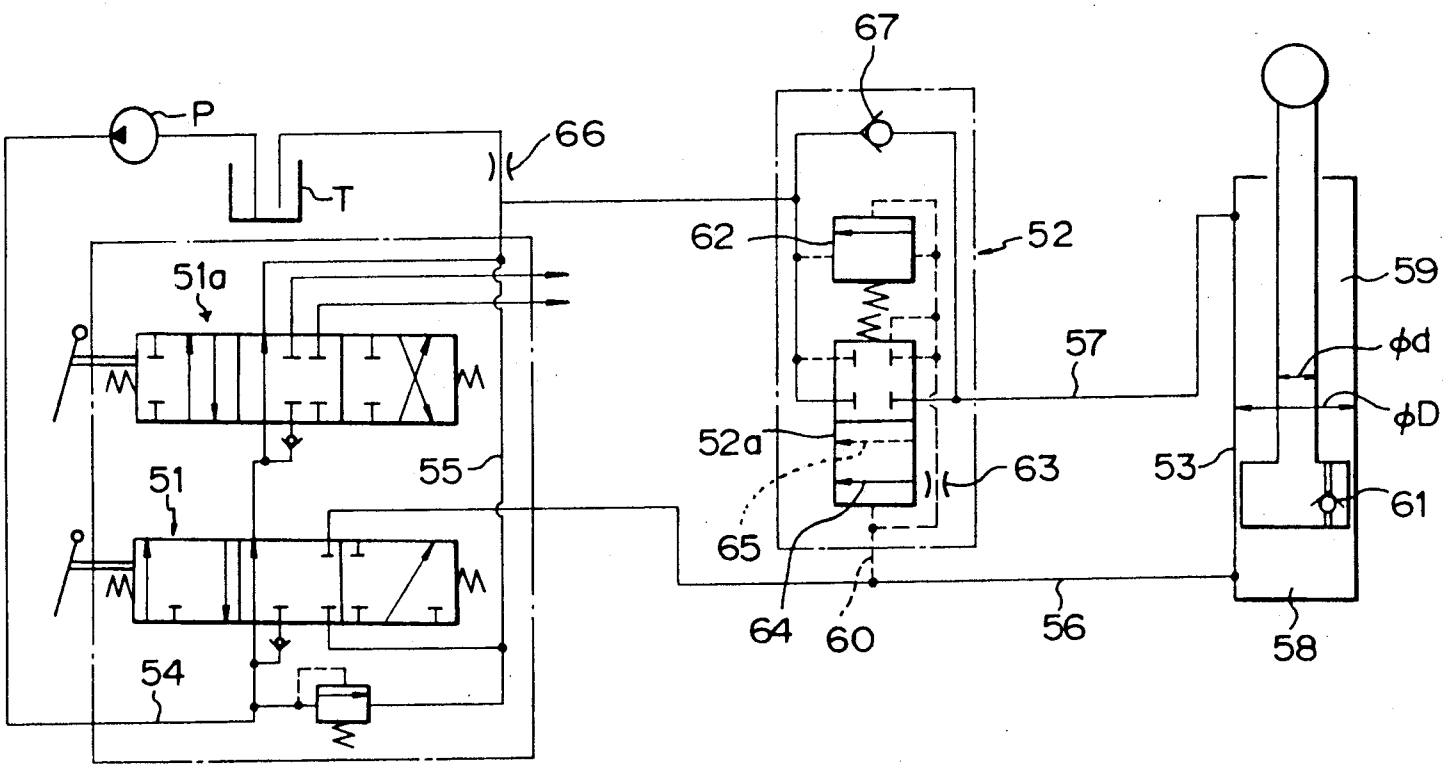
Fig. 19 (PRIOR ART)
FIG. 19 is a circuit diagram of a first type hydraulic control circuit arrangement for a single-acting lift cylinder according to the prior art.
Figure 23:
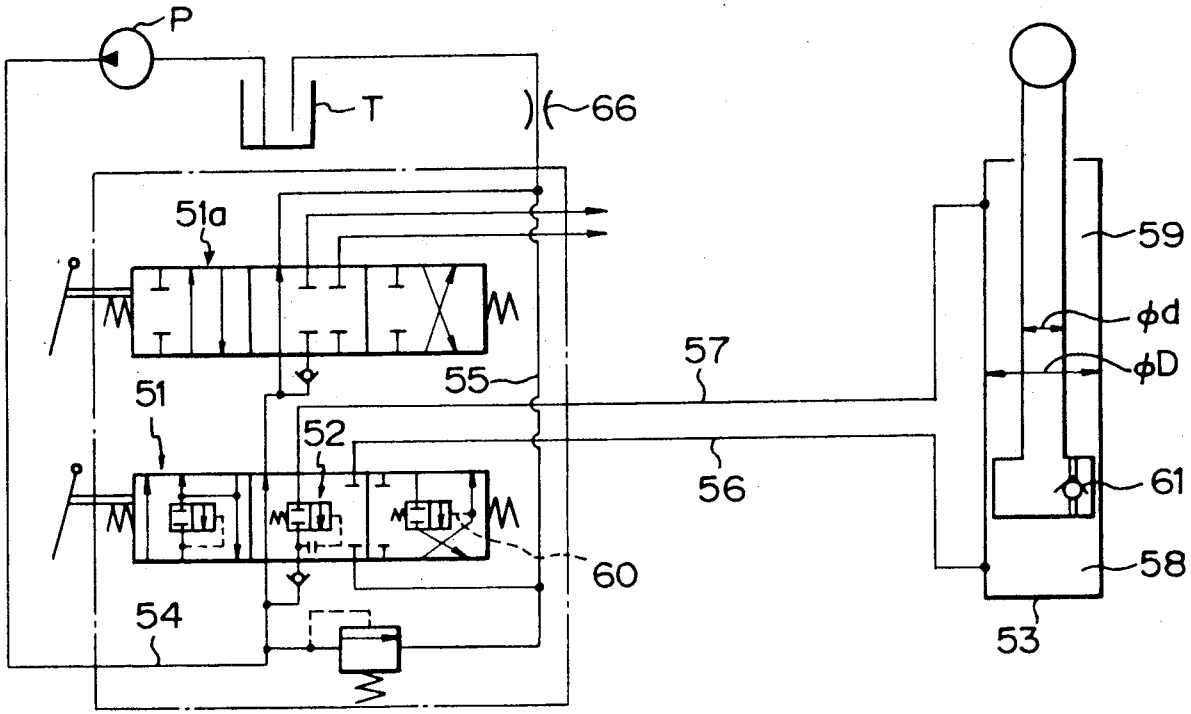
Fig. 23 (PRIOR ART)
FIG. 23 is a circuit diagram of a second type hydraulic control circuit arrangement for a single-acting lift cylinder according to the prior art, in which a pilot-operated valve is incorporated in a directional control valve.
Figure 24:
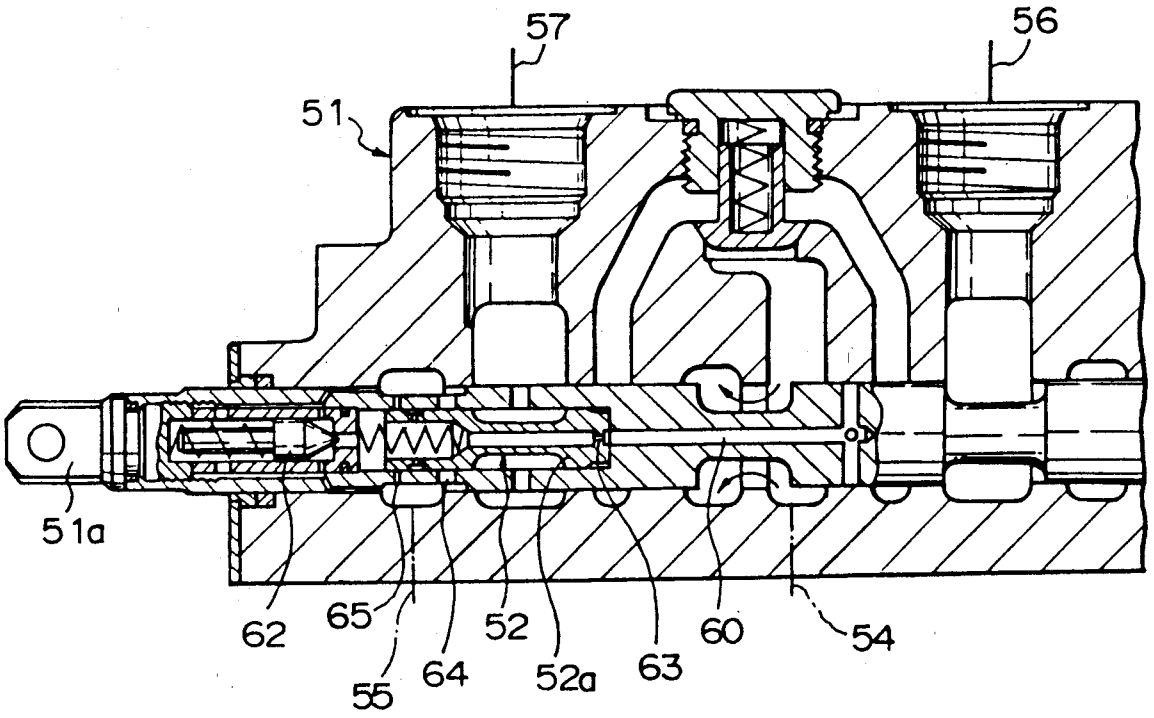
Fig. 24 (PRIOR ART)
FIG. 24 is a cross-sectional view of the directional control valve and the incorporated pilot-operated valve arranged in the control circuit arrangement of FIG. 23, and illustrating a neutral position of the directional control valve.
Figure 25:
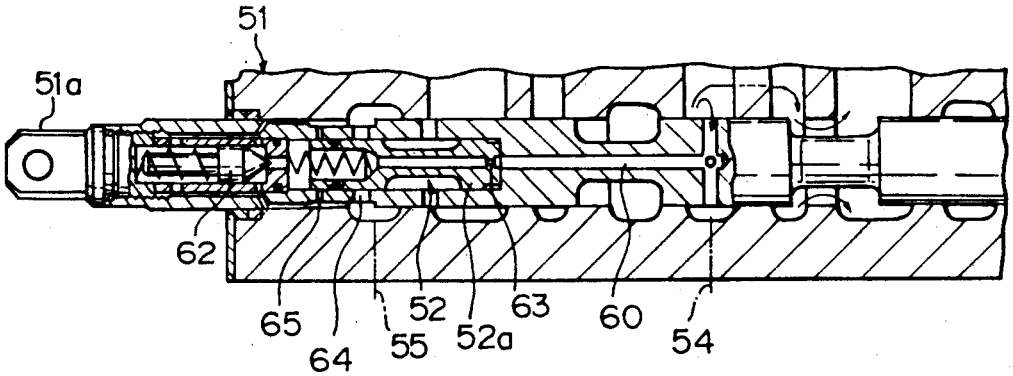
Fig. 25 (PRIOR ART)
FIGS. 25 and 26 are similar cross-sectional views of the directional control and pilot-operated valves of FIG. 24, and illustrating a position thereof whereat the single-acting lift cylinder is lifted.
Figure 26:
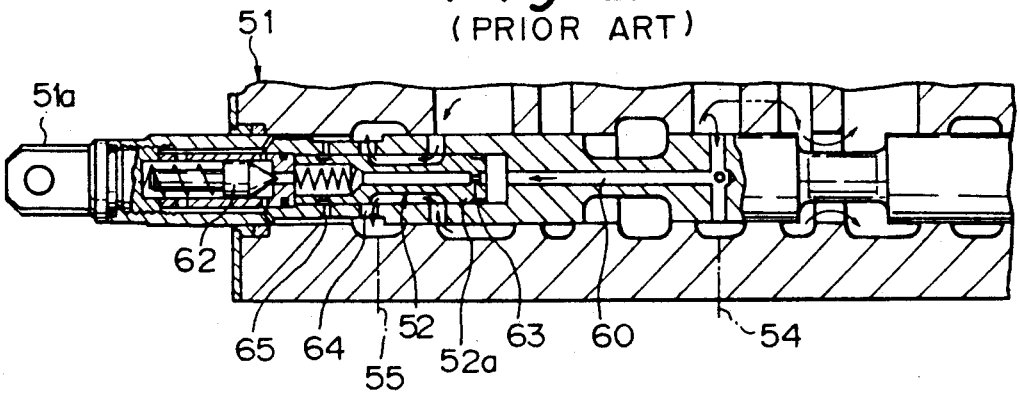
Fig. 26 (PRIOR ART)
Figure 27:
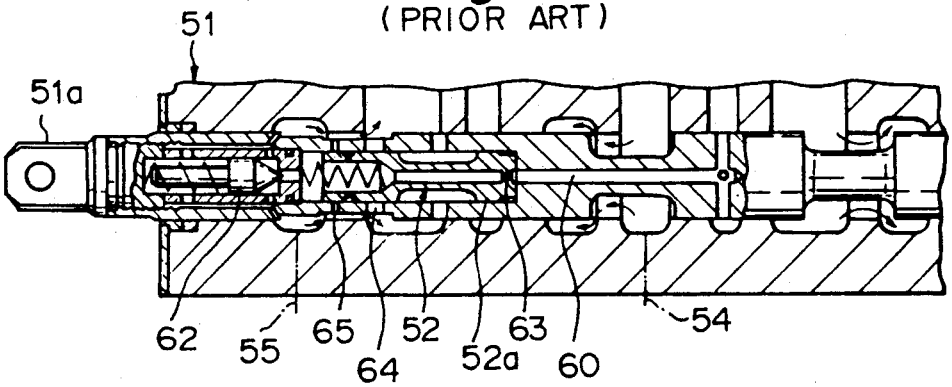
Fig. 27 (PRIOR ART)
FIG. 27 is a cross-sectional view of the directional control and pilot-operated valves of FIG. 24, and illustrating a position thereof whereat the single-acting cylinder is lowered.

Further, the pressure in the bottom side chamber **20*a* of the lift cylinder 20 will be applied to the rod side port 6 of the control valve 1 through the short-circuiting conduit 23 and that rod side conduit 12, and to the chamber in which the needle valve 17 is housed. Nevertheless, this pressure acts to urge the needle valve 17 to the closed position, and accordingly, a flow of the operating oil from the rod side port 6 connectable to the rod side conduit 12 toward the pump port 2 does not occur. Therefore, the operating oil is forcibly made to flow into the rod side chamber 20*b* from the bottom side chamber 20*a*, due to a pressure appearing in the bottom side chamber 20*a*, i.e., a pressure generated by the flow control valve 22 which limits an amount of flow of the operating oil from the chamber 20*a* toward the tank conduit 10 through the bottom side conduit 11, and a negative pressure appearing in the rod side chamber 20*b* due to the lowering motion of the lift cylinder 20. Therefore, it should be understood that the flow of the operating oil from the bottom side chamber 20*a* into the rod side changer 20*b* of the lift cylinder 20 is achieved by the use of the short-circuiting conduit 23 having a short conduit length compared with the prior art shown in FIG. 19 or 23, and accordingly, a small conduit resistance. As a result, when the lift cylinder 20 is lowered, the operating oil is able to smoothly flow from the bottom side of the lift cylinder 20** toward the rod side thereof, compared with the conventional hydraulic control circuit arrangement.

According to the above-described first embodiment of the present invention, as the flow control valve 22 having a check valve therein and the second pilot valve 24 are accommodated in the bottom housing of the single-acting lift cylinder 20, an arrangement of the pilot line 25 to connect the conduit 11 to the second pilot operated valve 24 can be realized by a single bore formed in the bottom housing of the lift cylinder 20, and an arrangement of separate pipes or tubes is not needed. Therefore, the costs for hydraulic parts and elements, and cost of assembling the control circuit arrangement, can be reduced compared with the conventional hydraulic control circuit arrangement.

Figure 7:
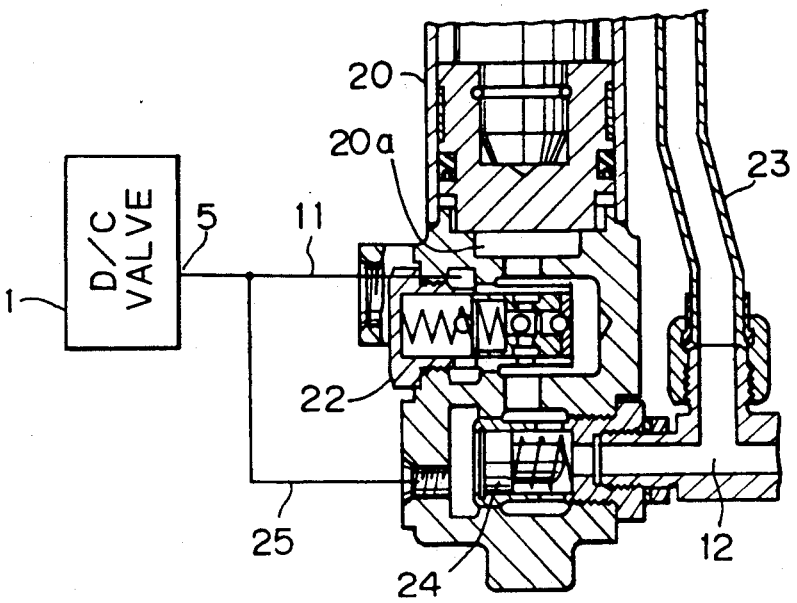
FIG. 7 is a cross-sectional view, illustrating a variation of the second pilot-operated valve of the control circuit arrangement of the first embodiment.

FIG. 7 illustrates a variation of the above-described first embodiment, in which the pilot oil for operating the second pilot-operated valve 24 is taken from the bottom side port 5 of the directional control valve 1 instead of an intermediate position of the bottom side conduit 11 shown in FIG. 1. This effectively suppresses any loss of pressure of the pilot oil during a flow of the pilot oil through the bottom side conduit 11, due to a flow resistance, and therefore, ensures an accurate shifting operation of the second pilot-operated valve 24.

Figure 8:
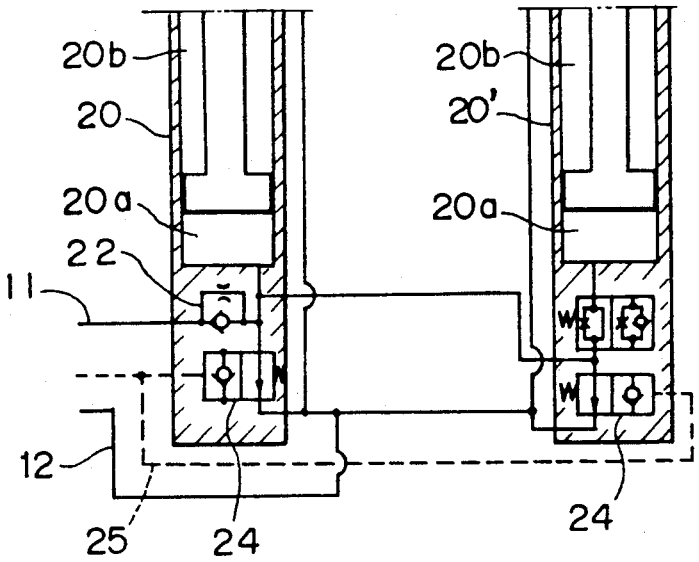
FIG. 8 is an explanatory circuit diagram illustrating a connection between two second pilot-operated valves accommodated in two lift cylinders.

It should be understood that, when the two lift cylinders 20 and 20' are controlled by the hydraulic control circuit arrangement according to the first embodiment, each of the two lift cylinders may be provided with a pilot-operated valve 24 as shown in FIG. 8.

Figure 9:
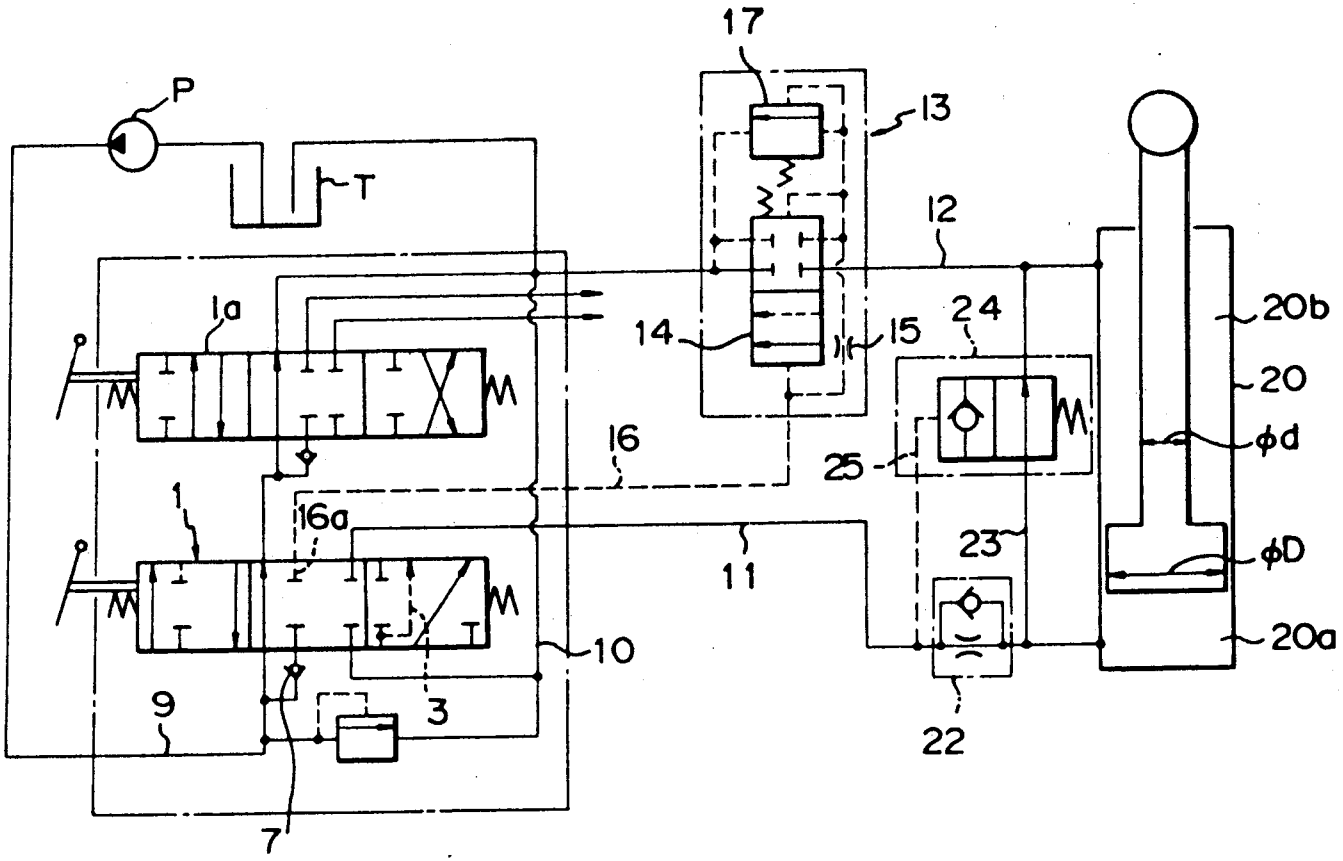
FIG. 9 is a circuit diagram illustrating a hydraulic control circuit arrangement for a single-acting lift cylinder according to a second embodiment of the present invention.
Figure 10:
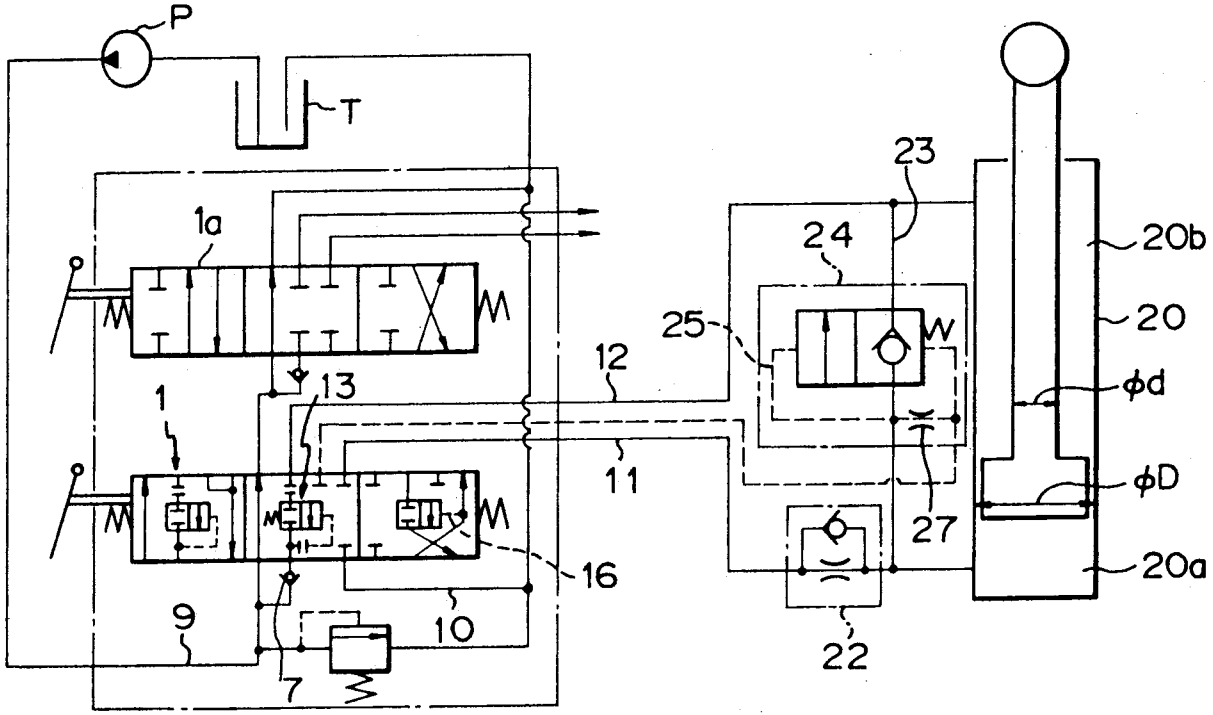
FIG. 10 is a circuit diagram illustrating a hydraulic control circuit arrangement for a single-acting lift cylinder according to a third embodiment of the present invention.

Referring to FIG. 9 illustrating a second embodiment of the present invention, the hydraulic controlling circuit arrangement is different from that of the first embodiment only in that a first pilot-operated valve 13 is arranged to be a single independent valve unit separated from a directional control valve 1. Therefore, the overall constructional features and the operation of this hydraulic control circuit arrangement of FIG. 9 are similar to those of the arrangement of the afore-mentioned first embodiment. Namely, a flow control valve 22 having a check valve is disposed in a bottom side conduit 11, and a second pilot-operated valve 24 is disposed in a short-circuiting conduit 23 providing a short-circuit fluid connection between the bottom side conduit 11 and a rod side conduit 12 of the single-acting cylinder 20, in a manner similar to the first embodiment.

The second embodiment of FIG. 9 is, however, different from the first embodiment of FIG. 1 in that the rod side conduit 12 extends from a rod side chamber (a second chamber) **20*b* of the single-acting cylinder 20 and connected to a tank conduit 10 via the first independent pilot-operated valve 13, which is arranged between the connecting point of the rod side conduit 12 and the short-circuiting conduit 23, and the connecting point of the rod side conduit 12 and the tank conduit 10. A pilot line 16 provided for controlling the operation of the first pilot-operated valve 13 has a pilot pressure inlet 16*a* which can be put in communication with a central by-pass passage 3 when the directional control valve 1 is shifted to a position whereat the operating oil is supplied to the single-acting cylinder 20 to lift the cylinder 20. The construction of the first pilot-operated valve 13 is the same as the afore-described conventional pilot-operated valve 52 of FIG. 20. Accordingly, in the present second embodiment, when the directional control valve 1 is manually shifted to the above-mentioned position to lift the single-acting cylinder 20, the pilot pressure inlet 16*a* of the pilot line 16 is connected with the central by-pass passage 3 of the directional control valve 1, and accordingly, a pilot pressure is introduced from the pilot pressure inlet 16*a* to control the operation of the first pilot-operated valve 13. When the pilot pressure is lower than a preset pressure value, i.e., when a light load is applied to the single-acting cylinder 20, the first pilot-operated valve 13 is maintained at a first position whereat the rod side conduit 12 is disconnected from the tank conduit 10, and therefore, the single-acting lift cylinder 20 acts as a ram type cylinder. When the pilot pressure is higher than the preset pressure value, i.e., when a heavy load is applied to the lift cylinder 20, the pilot-operated valve 13 is shifted to a second position whereat the rod side conduit 13 is connected to the tank conduit 10, and accordingly, the operating oil flows out of the rod side chamber 20*b* of the lift cylinder 20 toward the hydraulic tank T, and as a result, the lift cylinder 20** acts as a piston type cylinder. The remaining operation of the hydraulic controlling circuit arrangement of the second embodiment is similar to that of the first embodiment.

Figure 11:
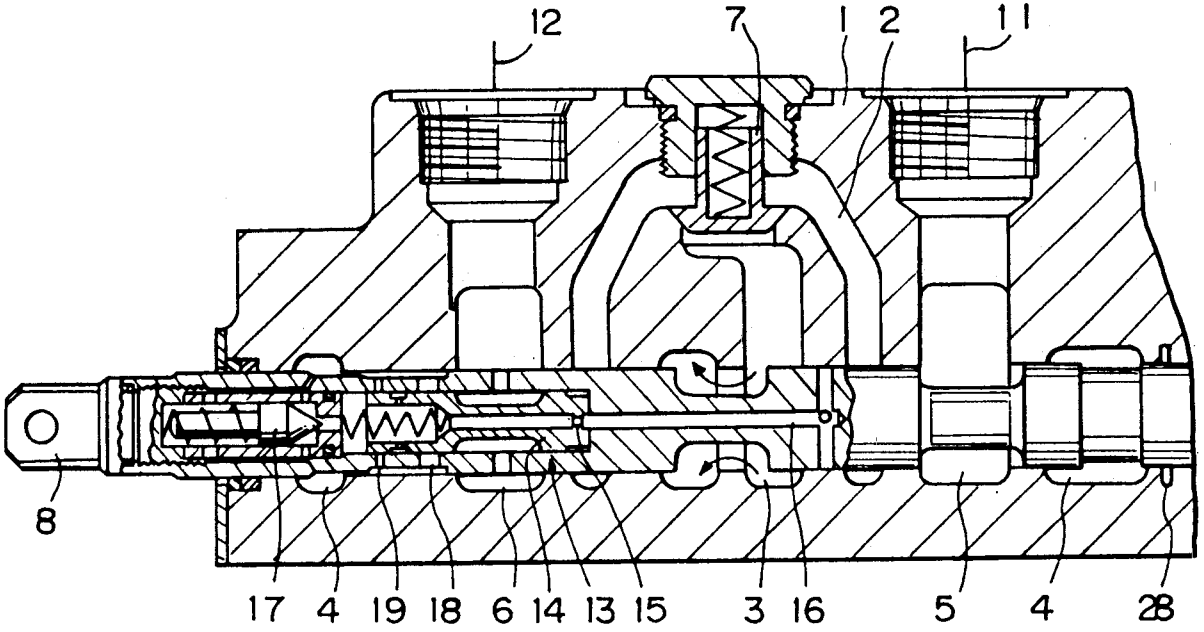
FIG. 11 is a cross-sectional view of a directional control valve incorporating a first pilot-operated valve therein and accommodated in the hydraulic control circuit arrangement of FIG. 10, and illustrating a neutral position of the directional control valve.
Figure 13:
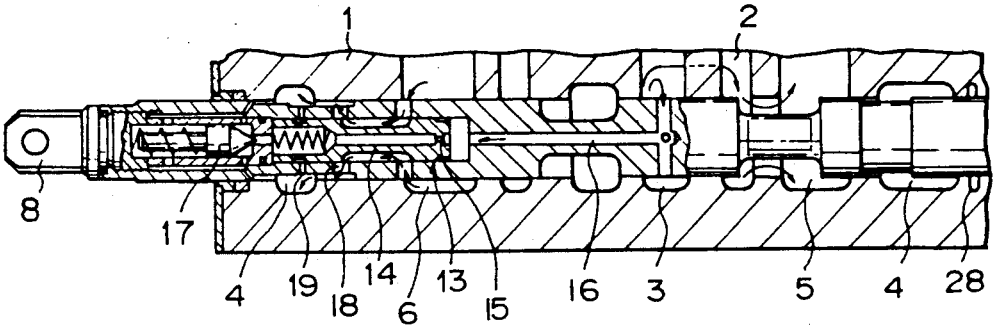
Figure 14:
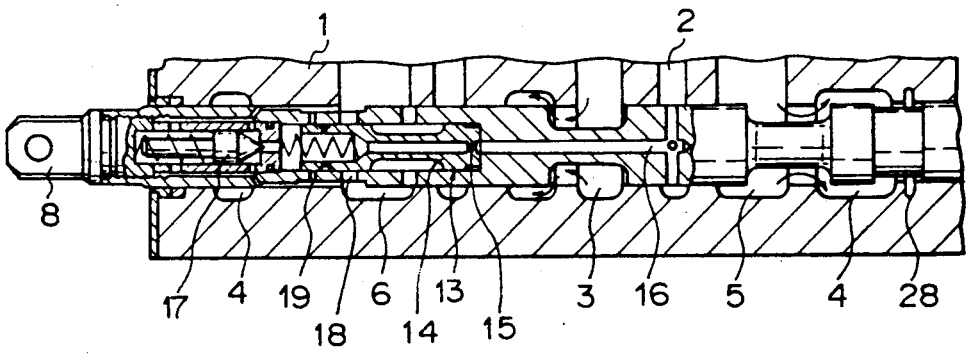
FIG. 14 is a cross-sectional view of the same valve as that of FIG. 11, illustrating a position of the directional control valve when lowering the single-acting lift cylinder.
Figure 15:
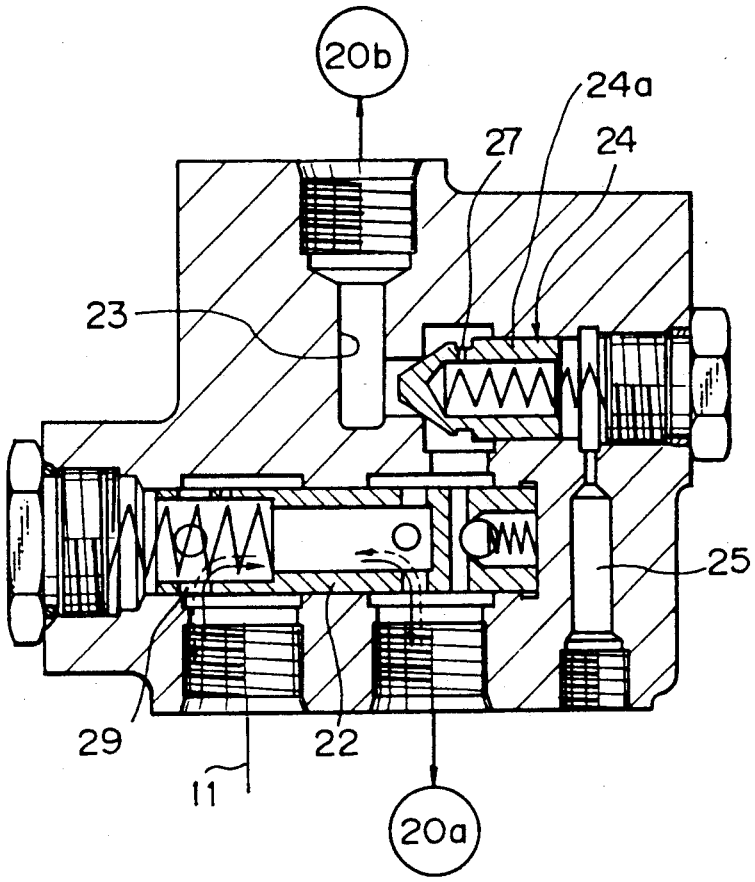
FIG. 15 is a cross-sectional view of a flow control valve and a second pilot-operated valve of the hydraulic control circuit arrangement of FIG. 10, and illustrating a construction for accommodating the two valves together as a single unit.

Referring to FIGS. 10 through 15, illustrating a third embodiment of the present invention, the hydraulic controlling circuit arrangement for a single-acting cylinder (a lift cylinder) 20 is characterized in that a check valve-incorporated flow control valve 22 disposed in a bottom side conduit 11 and a second pilot-operated valve 24 disposed in a short-circuiting conduit 23 are formed as an integral valve unit, as best shown in FIG. 15. The second pilot-operated valve 24 is comprised of a spring-biased poppet type valve having a poppet element **24*a* and an orifice 27. The orifice 27 generates a pressure differential thereacross when a pilot oil passes through the orifice 27, and accordingly, two different pressures act on two axial pressure receiving faces of the poppet element 24*a*, to thereby axially move the poppet element 24*a*. The above-mentioned pilot pressure used for moving the poppet element 24*a* of the second pilot-operated valve 24 are introduced from the short-circuiting conduit 23 at a position close to the bottom side chamber 20*a* of the single-acting lift cylinder 20 through a pilot line 25. A portion of the pilot line 25 located downstream of the orifice 27 is connected to a pressure relief port 28 of the directional control valve 1 as shown in FIG. 11. The pressure relief port 28 of the directional control valve 1 is communicated with a tank port 4 when a valve spool 8 of the directional control valve 1 is shifted to a position whereat the lift cylinder 20 is lowered. As long as the valve spool 8 is shifted to and stays at the remaining positions, i.e., the neutral position and the position for lifting the lift cylinder, the communication between the above-mentioned two ports 28 and 4** is interrupted.

As best illustrated in FIG. 15, the check valve-incorporated flow control valve 22 is comprised of a spool type valve. The flow control valve 22 is moved to and takes the rightmost position in FIG. 15 during the lifting of the lift cylinder 20, and therefore, the operating oil shown by solid arrow-lines flows into the flow control valve 22 through a passage 29. Broken arrow-lines in FIG. 15 designate a reverse flow of the operating oil in the flow control valve 22 during a lowering of the lift cylinder 20. In the latter state, a pressure of the operating oil in the bottom side conduit 11 on the side of the directional control valve 1 with respect to the flow control valve 22 is lower than that on the side of the bottom side chamber **20*a* of the lift cylinder 20, and therefore, the spool of the flow control valve 22 is shifted to the leftmost position in FIG. 15 due to the above-mentioned pressure difference. As a result, an area of the passage 29 is reduced in response to a load applied to the lift cylinder 20, to thereby control the amount of flow of the operating oil. The remaining construction and arrangement of the present embodiment are similar to those of the first embodiment of FIG. 1**.

When the directional control valve 1 is in the neutral position illustrated in FIG. 11, the rod side conduit 12 of the lift cylinder 20 is interrupted due to the closing of a rod side port 6. Further, the pressure relief port 28 through which a pressure in the pilot line 25 of the second pilot-operated valve 24 is relieved is closed, and accordingly, a pressure in the bottom side chamber **20*a* of the lift cylinder 20 acts on the second pilot-operated valve 24 through the short-circuiting conduit 23, the pilot line 25, and the orifice 27, to urge the poppet element 24*a* of the second pilot-operated valve 24 to the leftmost position in FIG. 15. Thus, the second pilot-operated valve 24 is maintained at a position allowing only the operating oil to flow from the rod side chamber 20***b* into the bottom side chamber 20*a*.

Figure 12:
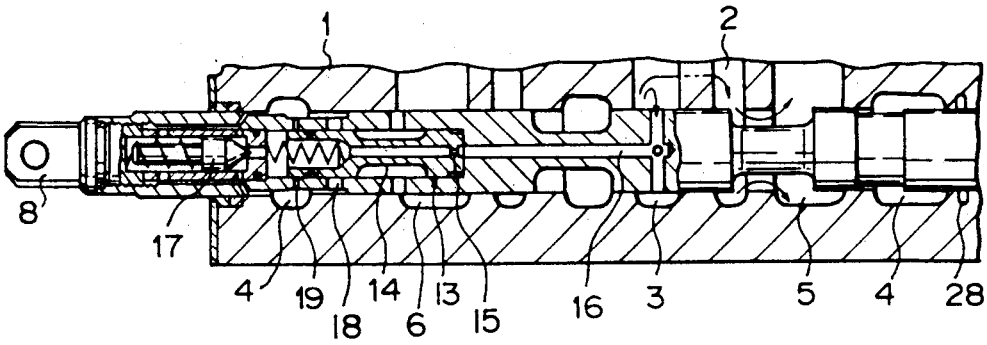
FIGS. 12 and 13 are cross-sectional views of the same valve as that of FIG. 11, illustrating a position of the directional control valve when lifting the single-acting lift cylinder, respectively.

When the valve spool 8 of the directional control valve 1 is manually shifted to a position for lifting the lift cylinder 20, i.e., a position illustrated in FIGS. 12 and 13, a pump port 2 and a bottom side port 5 are communicated with one another, and therefore, the operating oil from a pump conduit 9 is supplied into the bottom side chamber 20*a* through the bottom side conduit 11. At this stage, when a pressure in the bottom side chamber 20*a*, i.e., a pressure in the central by-pass passage 3 of the directional control valve 1 is lower than a preset pressure value of a needle valve 17 of a first pilot-operated valve 13, namely, a light load is applied to the lift cylinder 20, the rod side conduit 12 is interrupted by the directional control valve 1 as illustrated in FIG. 12. The second pilot-operated valve 24 is maintained at the same position as the above-mentioned case of the neutral position of the directional control valve 1. Therefore, the second pilot-operated valve 24 allows only the operating oil to flow from the rod side chamber 20*b* into the bottom side chamber 20*a* of the lift cylinder 20. Accordingly, the lift cylinder 20 acts as a ram cylinder having a pressure receiving area corresponding to a cross-sectional area of the piston rod having a diameter "d".

When the pressure in the central by-pass passage 3 of the directional control valve 1 is raised above the preset pressure value of the needle valve 17 of the first pilot-operated valve 13, i.e., when a heavy load is applied to the lift cylinder 20, the needle valve 17 is shifted to an open position thereof illustrated in FIG. 13 due to a pressure acting through the pilot line 16, and a pilot oil flows through an orifice 15 of the first pilot operated valve 13 to thereby generate a pressure differential across the orifice 15. As a result, the pilot spool 14 is moved leftward to open a passage 18, and accordingly, the rod side port 6 and the tank port 4 of the directional control valve 1 are fluidly connected with one another. Namely, the rod side conduit 12 is connected to the tank conduit 10. As the second pilot-operated valve 24 is maintained at the same position as the above-mentioned light load application to the lift cylinder 20, i.e., at the position allowing only the operating oil to flow from the rod side chamber 20*b* toward the bottom side chamber 20*a* through the second pilot operated valve 24, the lift cylinder 20 acts as a piston type cylinder having a pressure receiving area corresponding to a cross-sectional area of the piston having a diameter "D". When the lift cylinder 20 carries out the operation of the piston type cylinder, the pressure in the pilot line 16 initially and temporarily drops, and therefore, the needle valve 17 is shifted to the closing position thereof. At this time, when the pilot spool 14 is shifted to a position whereat the rod side port 6 is communicates with the tank port 4 via the passage 18, the pilot line 16 is communicated with the tank port 4 via a passage 19, and accordingly, a flow of the pilot oil is constantly maintained in the pilot line 16. Therefore, a pressure differential constantly appears across the orifice 15 to urge the pilot spool 14 toward the open position thereof, until the directional control valve 1 is shifted to the neutral position illustrated in FIG. 11.

When the valve spool 8 of the directional control valve 1 is manually shifted to a position for lowering the lift cylinder 20, i.e., a position shown in FIG. 14, the bottom side port 5 is communicates with the tank port 4 from which the rod side or is interrupted by the valve spool 8. Simultaneously, the pressure relief port 28 for a pressure in the pilot line 25 of the second pilot-operated valve 24 is also communicates with the tank port 4 of the directional control valve 1, and therefore, a pilot oil flows in the pilot line 25, whereby a pressure differential appears across the orifice 27. Namely, in FIG. 15, a difference appears between pressures acting on both pressure receiving faces of the poppet element 24*a* of the second pilot-operated valve 24, and accordingly, the poppet element 24*a* of the second pilot operated valve 24 is moved rightward in FIG. 15, and therefore, the short-circuiting conduit 23 effectively establishes a complete communication between the bottom side and rod side conduits 11 and 12. As a result, the operating oil in the bottom side chamber 20*a* flows into the rod side chamber 20*b* of the lift cylinder 23.

In the position of FIG. 14 of the directional control valve 1, an inlet of a pilot pressure for the first pilot-operated valve 13 is moved to a position corresponding to the pump port 2 of the directional control valve 1. Therefore, a given pressure may be taken from the pump port 2 through the pilot pressure inlet into the pilot line 16 and cause the pilot spool 14 to shift to the leftward position within the valve spool 8. Nevertheless, regardless of this movement of the pilot spool 14, the rod side port 6 connectable to the rod side conduit 12 is not communicated with the tank port 4. Moreover, although the pressure in the bottom side chamber 20*a* of the lift cylinder 20 acts on the rod side port 6 of the directional control valve 1, and prevails in a chamber housing the needle valve 17 therein, the needle valve 17 is urged toward the closing position thereof, and therefore, a flow of the operating oil from the rod side port 6 toward the pump port 2 does not occur. Thus, the operating oil is forcibly made to flow into the rod side chamber 20*b* from the bottom side chamber 20*a* of the lift cylinder 20 under a pressure caused by the flow control valve 22 and a negative pressure appearing in the rod side chamber 20*b* during the lowering of the piston and piston rod of the lift cylinder 20.

Figure 16:
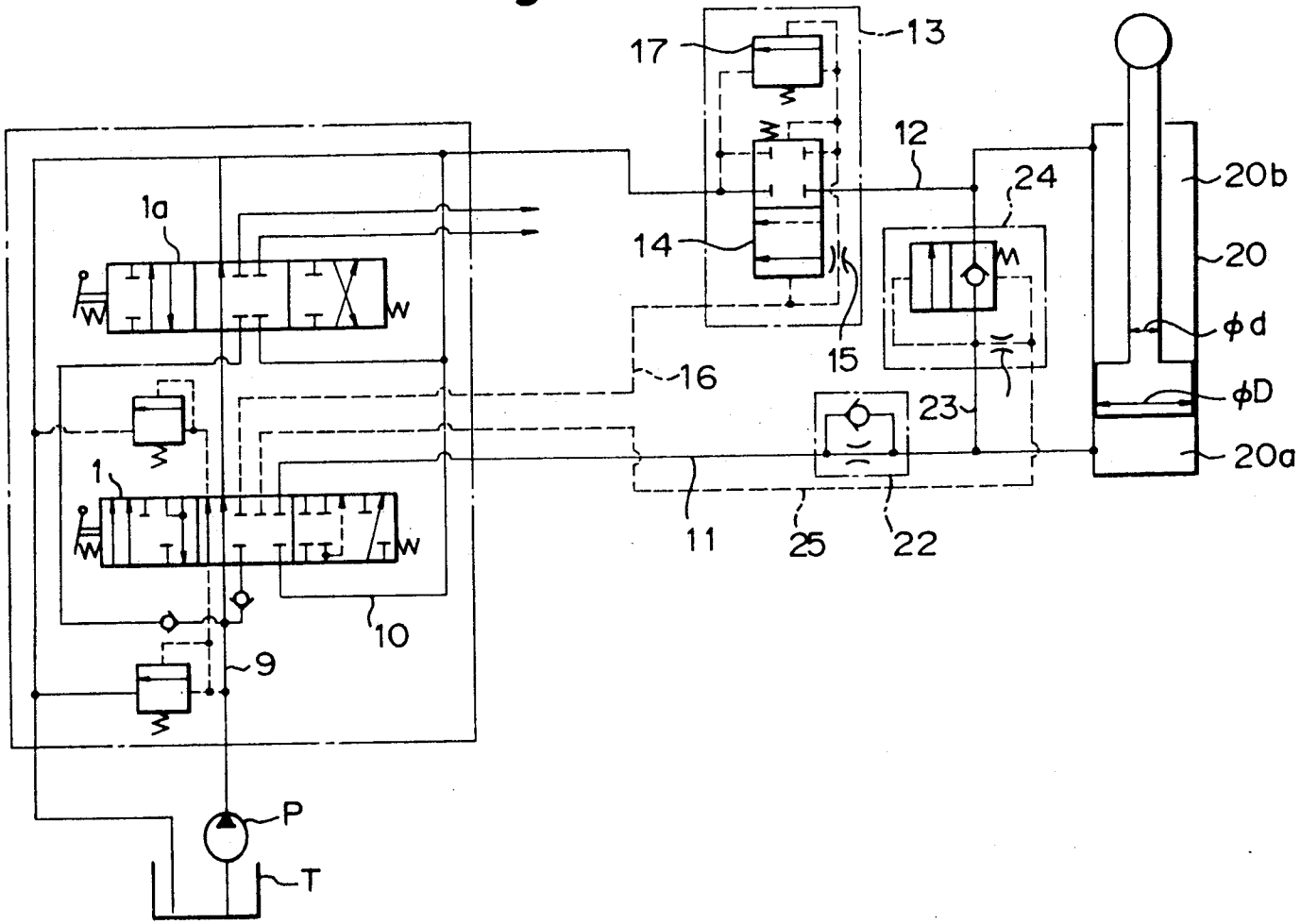
FIG. 16 is a circuit diagram illustrating a hydraulic control circuit arrangement for a single-acting lift cylinder according to a fourth embodiment of the present invention.
Figure 17:
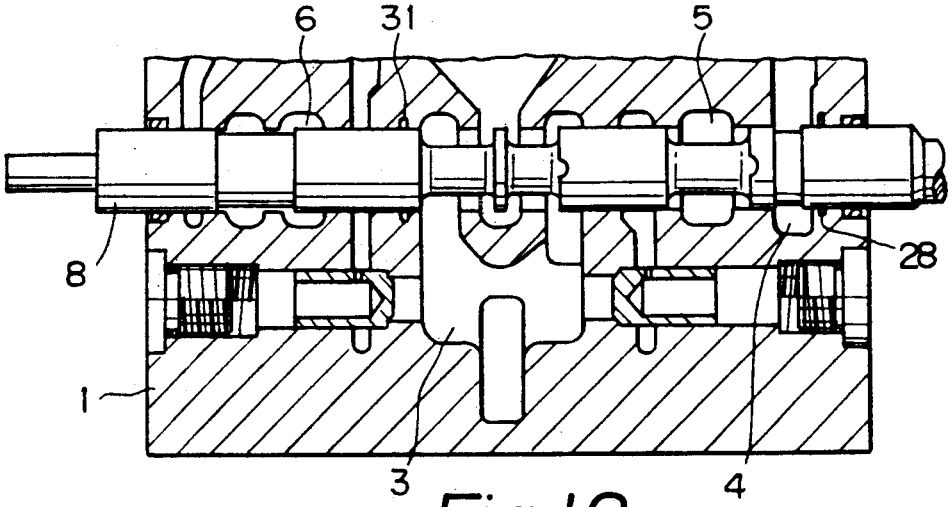
FIG. 17 is a cross-sectional view illustrating the construction of a directional control valve of the hydraulic control circuit arrangement of FIG. 16.
Figure 18:
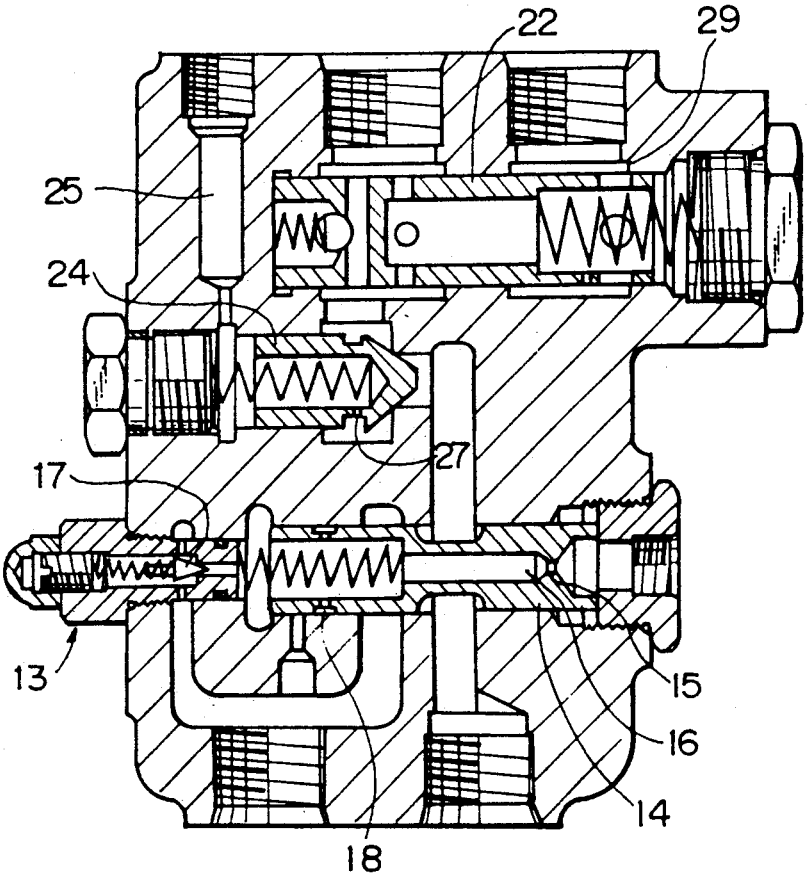
FIG. 18 is a cross-sectional view of a unit in which a first pilot-operated valve, a flow control valve, and a second pilot-operated valve of the hydraulic control circuit arrangement are accommodated together.

Referring to FIGS. 16 through 18 illustrating a fourth embodiment of the present invention, the hydraulic control circuit arrangement for a single-acting cylinder (a lift cylinder) 20, includes a first pilot-operated valve 13 arranged independently from a directional control valve 1. Note, the first pilot-operated valve 13 is assembled as an integral valve unit together with a second pilot-operated valve 24 and a flow control valve 22 as illustrated in FIG. 18.

On the other hand, as illustrated in FIG. 17, the directional control valve 1 includes a relief port 28 similar to the relief port 28 of the third embodiment, which is effective for generating a pilot pressure to be applied to a second pilot-operated valve 24 at the stage of lowering the lift cylinder 20 by the shift of the directional control valve 1. The directional control valve 1 is also provided with a pilot pressure taking port 31 through which a pilot pressure is applied to the first pilot-operated valve 13 only when the directional control valve 1 is shifted to a position for lifting the lift cylinder 20. The pilot pressure taking port 31 is communicated with a central by-pass passage 3 of the directional control valve 1 when a valve spool 8 of the valve 1 is shifted to that position (the leftmost position in FIG. 17) for lifting the lift cylinder 20, and is closed when the valve spool 8 of the directional control valve 1 is shifted to the neutral and cylinder lowering positions, respectively. Therefore, when the directional control valve 1 of the fourth embodiment is shifted to the above-mentioned cylinder lifting position, the second pilot-operated valve 24 is maintained at a position whereat only an operating oil is allowed to flow from a rod side chamber 20*b* (a second chamber) into a bottom side chamber 20*a* (a first chamber) due to closing of the pressure relief port 28. This operation of the second pilot-operated valve 24 is the same as that of the third embodiment. In the first pilot-operated valve 13, the needle valve 17 is subjected to a pilot pressure coming from the pilot pressure taking port 31 communicated with the central by-pass passage 3 of the directional control valve 1. When the pilot pressure is lower than a preset pressure value of the needle valve 17, i.e., when a light load is applied to the lift cylinder 20, the first pilot-operated valve 13 is stopped at a position interrupting a rod side conduit 12, and the operating oil is allowed to flow from the rod side chamber 20*b* into the bottom side chamber 20*a* of the lift cylinder through a short-circuiting conduit 23. As a result, the lift cylinder acts as a ram type cylinder having a pressure receiving area corresponding to a cross-sectional area of the piston rod having a diameter "d".

On the other hand, when the pilot pressure is raised above the preset pressure value of the needle valve 17, i.e., a heavy load is applied to the lift cylinder 1, the first pilot-operated valve 13 is shifted to a position whereat the rod side conduit 12 is communicated with a tank conduit 10, the operating oil is allowed to flow from the rod side chamber 20*b* toward the hydraulic tank T through the first pilot-operated valve 13 and the tank conduit 10, and as a result, the lift cylinder 20 acts as a piston type cylinder having a pressure receiving area corresponding to a cross-sectional area of the piston having a diameter "D".

When the directional control valve 1 is shifted to the cylinder lowering position, the pilot pressure taking port 31 of the first pilot-operated valve 13 is closed, and the relief port 28 of the valve 1 for the second pilot operated valve 24 is opened to shift the valve 24 to a position whereat the short-circuiting conduit 23 is able to establish a complete communication between the bottom side and rod side chambers 20*a* and 20*b* of the lift cylinder 20. As a result, the operating oil is forcibly made to flow from the bottom side chamber 20*a* into the rod side chamber 20*b*, due to a pressure appearing in the bottom side chamber 20*a* per se.

Throughout the foregoing four embodiments, although the second pilot operated hydraulic valve 24 is arranged in the short-circuiting conduit 23 bridging the bottom side and rod side chambers 20*a* and 20*b* of the single-acting lift cylinder 20, a solenoid-operated type valve may be employed and driven in response to the shifting operating of the directional control valve 1. Namely, the solenoid-operated valve is operated in such a manner that, when the directional control valve 1 is shifted to the cylinder lowering position, the short-circuiting conduit 23 completely connects the bottom side chamber 20*a* to the rod side chamber 20*b*, and when the directional control valve 1 is shifted to either the neutral position or the cylinder lifting position, only the operating oil is allowed to flow from the rod side chamber 20*b* to the bottom side chamber 20*a* of the lift cylinder 20.

Further, the hydraulic control circuit arrangement according to the present invention is not exclusively used for controlling the operation of the described lift cylinders of a forklift truck but can be used for many kinds of single-acting hydraulic cylinders.

From the foregoing description of the first through fourth embodiments of the present invention, it will be understood that, according to the hydraulic control circuit arrangement of the present invention, the single-acting cylinder capable of acting as either a ram type cylinder or a piston type cylinder corresponding to an extent of a load applied thereto can be accurately operated because the operating oil always can flow from the bottom side chamber to the rod side chamber through the short-circuiting conduit during the contracting or lowering motion of the cylinder, due to a hydraulic pressure generated in the bottom side chamber of the single-acting cylinder. Accordingly, a time lag problem in the operation of the single-acting cylinder encountered by the conventional hydraulic control circuit is solved. In addition, problems such as an energy loss of the operating oil and an unfavorable rise in the temperature of the operating oil due to the existence of an orifice or throttle in the operating oil return conduit can be solved.

Moreover, according to the present invention, the use of the short-circuiting conduit for the flow of the operating oil from the bottom side to rod side chamber can contribute to a shortening of the entire length of the hydraulic conduit, while reducing a flow resistance to the flow of the operating oil. As a result, it is possible to reduce the diameter of the hydraulic conduits arranged between upright masts of a forklift truck when the single-acting cylinders are used as lift cylinders of the forklift truck, and consequently, the forward view from the forklift truck can be improved.

It should be understood that further modifications and variations will occur to persons skilled in the art without departing from the scope and spirit of the present invention claimed in the appended claims.

We claim:

1. A hydraulic control circuit arrangement for a single-acting cylinder having a slidable piston element in a cylinder housing, a first cylinder chamber facing the piston element, a second cylinder chamber separated from the first chamber by the piston element, and a piston rod extending from the piston element to an outer end thereof through the second cylinder chamber, comprising:

a hydraulic power source for supplying an operating oil for operating the single-acting cylinder;

a hydraulic tank for receiving and storing the operating oil;

a directional control valve arranged between the hydraulic power source and the single-acting cylinder for controlling a supply of the operating oil from the hydraulic power source to the single-acting cylinder, the directional control valve being shiftable from a neutral position thereof to one of a first position whereat the first cylinder chamber of the single-acting cylinder is connected to the hydraulic power source and a second position whereat the first chamber of the single-acting cylinder is connected to the hydraulic tank;

a first conduit of the operating oil for providing a fluid connection between the fist cylinder chamber of the single-acting cylinder and the directional control valve;

a second conduit of the operating oil for providing a fluid connection between the second cylinder chamber of the single-acting cylinder and the hydraulic tank;

a third conduit of the operating oil for providing a short-circuiting fluid connection between the first and second cylinder chambers of the single-acting cylinder;

a first pilot-operated valve for controlling an evacuation of the operating oil from the second cylinder chamber of the single-acting cylinder through the second conduit in response to a change in a pressure in the first cylinder chamber of the single-acting cylinder with respect to a preset pressure when the directional control valve is shifted to and maintained at the first position thereof;

a flow control valve arranged in the first conduit and having an inlet port thereof directly and fluidly connected to both the first cylinder chamber of the single-acting cylinder and the third conduit, and an outlet port thereof directly connected to the directional control valve, the flow control valve controlling a flow of the operating oil in the first conduit when the operating oil is allowed to flow out of the first cylinder chamber of the single-acting cylinder, to thereby generate a pressure differential thereacross; and a second pilot-operated valve arranged in the third conduit and urged to a first position thereof providing short-circuit fluid connection between the first and second chambers of the single-acting cylinder through the third conduit when the directional control valve is shifted to the second position thereof, the second pilot-operated valve being connected to said first conduit at a position adjacent to said outlet port of said flow control valve, through a pilot line, and shifted from the first position thereof to a second position thereof to allow only the operating oil to flow from the second to first cylinder chamber of the single-acting cylinder, when the directional control valve is shifted to the first position.

2. A hydraulic control circuit arrangement according to claim 1, wherein said single-acting cylinder is a lift cylinder for lifting a load when said operating oil is supplied to said first cylinder chamber, and lowering a load when the operating oil is removed from said first cylinder chamber.

3. A hydraulic control circuit arrangement according to claim 1, wherein said first pilot operated valve is integrally accommodated in said directional control valve.

4. A hydraulic control circuit arrangement according to claim 3, wherein said second conduit provides a fluid connection between said second cylinder chamber of said single-acting cylinder and said hydraulic tank via said directional control valve.

5. A hydraulic control circuit arrangement according to claim 1, wherein said first pilot-operated valve comprises a valve unit separated from said directional control valve, and arranged between said second cylinder chamber of said lift cylinder and said hydraulic tank, said fist pilot-operated valve being operated by a pilot pressure directly supplied from said hydraulic power source via said directional control valve when said directional control valve is shifted to said firs position thereof.

6. A hydraulic control circuit arrangement according to claim 3, wherein said second conduit provides a fluid connection between said second cylinder chamber of said single-acting cylinder and said hydraulic tank via said first pilot operated valve.

7. A hydraulic control circuit arrangement according to claim 1, wherein said flow control valve arranged in said first conduit comprises a check valve incorporating a spool valve therein.

8. A hydraulic control circuit arrangement according to claim 1, wherein said second pilot-operated valve comprises a check valve incorporating a poppet valve therein.

9. A hydraulic control circuit arrangement according to claim 1, wherein said flow control valve and said second pilot-operated valve are integrally accommodated in said cylinder housing of said single-acting cylinder and located adjacent to said first cylinder chamber.

10. A hydraulic control circuit arrangement for a single-acting cylinder having a slidable piston element in a cylinder housing, a first cylinder chamber facing the piston element, a second cylinder chamber separated from the first chamber by the piston element, and a piston rod extending from the piston element to an outer end thereof through the second cylinder chamber, comprising:

a hydraulic power source for supplying an operating oil for operating the single-acting cylinder;

a hydraulic tank for receiving and storing the operating oil;

a directional control valve arranged between the hydraulic power source and the single-acting cylinder for controlling a supply of the operating oil from the hydraulic power source to the single-acting cylinder, the directional control valve being shiftable from a neutral position thereof to one of a first position whereat the first cylinder chamber of the single-acting cylinder is connected to the hydraulic power source and a second position whereat the first chamber of the single-acting cylinder is connected to the hydraulic tank;

a first conduit of the operating oil for providing a fluid connection between the first cylinder chamber of the single-acting cylinder and the directional control valve;

a second conduit of the operating oil for providing a fluid connection between the second cylinder chamber of the single-acting cylinder and the hydraulic tank;

a third conduit of the operating oil for providing a short-circuiting fluid connection between the first and second cylinder chambers of the single-acting cylinder;

a first pilot-operated vale for controlling an evacuation of the operating oil from the second cylinder chamber of the single-acting cylinder through the second conduit in response to a change in a pressure in the first cylinder chamber of the single-acting cylinder with respect to a preset pressure when the directional control valve is shifted to and maintained at the first position thereof;

a flow control valve arranged in the first conduit and having an inlet port thereof directly and fluidly connected to both the first cylinder chamber of the single-acting cylinder and the third conduit, and an outlet port thereof directly connected to the directional control valve, the flow control valve controlling a flow of the operating oil in the first conduit when the operating oil is allowed to flow out of the first cylinder chamber of the single-acting cylinder, to thereby generate a pressure differential thereacross; and a second pilot-operated valve arranged in the third conduit and urged to a first position thereof providing a short-circuit fluid connection between the first and second chambers of the single-acting cylinder through the third conduit when the directional control valve is shifted to the second position thereof, the second pilot-operated valve being connected to one port of said directional control valve, said one port being a port for supplying said operating oil to said first conduit when said directional control valve is shifted to said first position thereof, said second pilot-operated valve being shifted from the first position thereof to a second position thereof to allow only the operating oil to flow from the second to first cylinder chamber of the single-acting cylinder when the directional control valve is shifted to the first position.

11. A hydraulic control circuit arrangement according to claim 10, wherein said single-acting cylinder is a lift cylinder for lifting a load when the operating oil is supplied to said first cylinder chamber, and lowering a load when the operating oil is removed from said first cylinder chamber.

12. A hydraulic control circuit arrangement according to claim 10, wherein said first pilot operated valve is integrally accommodated in said directional control valve.

13. A hydraulic control circuit arrangement according to claim 12, wherein said second conduit provides a fluid connection between said second cylinder chamber of said single-acting cylinder and said hydraulic tank via said directional control valve.

14. A hydraulic control circuit arrangement according to claim 10, wherein said first pilot-operated valve comprises a valve unit separated from said directional control valve, and arranged between said second cylinder chamber of said lift cylinder and said hydraulic tank, said first pilot-operated valve being operated by a pilot pressure directly supplied from said hydraulic power source via said directional control valve when said directional control valve is shifted to said first position.

15. A hydraulic control circuit arrangement according to claim 14, wherein said second conduit provides a fluid connection between said second cylinder chamber of said single-acting cylinder and said hydraulic tank via said first pilot operated valve.

16. A hydraulic control circuit arrangement according to claim 10, wherein said flow control valve arranged in said firs conduit comprises a check valve incorporating a spool valve therein.

17. A hydraulic control circuit arrangement according to claim 10, wherein said second pilot-operated valve comprises a check valve incorporating a poppet valve therein.

18. A hydraulic control circuit arrangement according to claim 10, wherein said flow control valve and said second pilot-operated valve are integrally accommodated in said cylinder housing of said single-acting cylinder and located adjacent to said first cylinder chamber.

19. A hydraulic control circuit arrangement for a single-acting cylinder having a slidable piston element in a cylinder housing, a firs cylinder chamber facing the piston element, a second cylinder chamber separated from the first chamber by the piston element, and a piston rod extending from the piston element to an outer end thereof through the second cylinder chamber, comprising:

a hydraulic power source for supplying an operating oil for operating the single-acting cylinder;

a hydraulic tank for receiving and storing the operating oil;

a directional control valve arranged between the hydraulic power source and the single-acting cylinder for controlling a supply of the operating oil from the hydraulic power source to the single-acting cylinder, the directional control valve being shiftable from a neutral position thereof to one of a first position whereat the first cylinder chamber of the single-acting cylinder is connected to the hydraulic power source and a second position whereat the first chamber of the single-acting cylinder is connected to the hydraulic tank;

a first conduit for the operating oil for providing a fluid connection between the first cylinder chamber of the single-acting cylinder and the directional control valve;

a second conduit of the operating oil for providing a fluid connection between the second cylinder chamber of the single-acting cylinder and the hydraulic tank;

a third conduit of the operating oil for providing a short-circuiting fluid connection between the first and second cylinder chambers of the single-acting cylinder;

a first pilot-operated valve for controlling an evacuation of the operating oil from the second cylinder chamber of the single-acting cylinder through second conduit in response to a chane in a pressure in the fist cylinder chamber of the single-acting cylinder with respect to a preset pressure when the directional control valve is shifted to and maintained at the first position thereof;

a flow control valve arranged in the first conduit and having an inlet port thereof directly and fluidly connected to both the first cylinder chamber of the single-acting cylinder and the third conduit, and an outlet port thereof directly connected to the directional control valve, the flow control valve controlling a flow of the operating oil in the first conduit when the operating oil is allowed to flow out of the first cylinder chamber of the single-acting cylinder, to thereby generate a pressure differential thereacross; and a second pilot-operated valve arranged in the third conduit and urged to a first position thereof providing a short-circuit fluid connection between the first and second chambers of the single-acting cylinder through the third conduit when the directional control valve is shifted to the second position thereof, the second pilot-operated valve being shifted from the first position thereof to a second position thereof to allow only the operating oil to flow from the second to first cylinder chamber of the single-acting cylinder, when the directional control valve is shifted to the first position, said flow control valve and said first and second pilot-operated valves being integrally assembled into a single valve unit independent from said directional control valve, and said first and second pilot-operated valves being provided with respective pilot lines connected to pilot pressure obtaining ports formed in said directional control valve.

20. A hydraulic control circuit arrangement according to claim 19, wherein said single-acting cylinder is a lift cylinder for lifting a load when said operating oil is supplied to said first cylinder chamber, and lowering a load when the operating oil is removed from said first cylinder chamber.

* * * * *

UNITED STATES PATENT AND TRADEMARK OFFICE

CERTIFICATE OF CORRECTION

PATENT NO. : 5,065,664

DATED : November 19, 1991

INVENTOR(S) : S. Ohta et al

It is certified that error appears in the above-identified patent and that said Letters Patent is hereby corrected as shown below:

Col. 2, line 35, after "cylinder," delete "a". (second occurrence)

Col. 5, line 21, after "a" (second occurrence), insert --hydraulic control circuit arrangement for a single- --.

Col. 6, line 67, "la" should read --1a--. (bold "l" and italicized a").

Col. 8, line 55, delete "Namely", insert --That is,--.

Col. 9, line 68, "pravailing" should read --prevailing--.

Col. 11, line 36, "in" should read --into--.

Col. 13, line 55, delete "is"; line 67, delete "is".

Col. 14, line 16, change "23" to --20--.

Col. 16, line 62 "fist" should read --first--.

Col. 17, line 26, after "ing" insert --a--; line 59, "fist" should read --first--; line 62, "firs" should read --first--.

Col. 19, line 49, "firs" should read --first--; line 63, "firs" should read --first--.

UNITED STATES PATENT AND TRADEMARK OFFICE

CERTIFICATE OF CORRECTION

PATENT NO. : 5,065,664

DATED : November 19, 1991

INVENTOR(S) : S. Ohta et al

It is certified that error appears in the above-identified patent and that said Letters Patent is hereby corrected as shown below:

Col. 20, line 15, change "for" (first occurrence) to --of--; line 28, after "through" insert --the--; line 30, "fist" should read --first--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*